US005933931A

United States Patent [19]

Greenway

[11] Patent Number: 5,933,931

[45] Date of Patent: Aug. 10, 1999

[54] TURBULENCE-INDUCED HYRDROENHANCING FOR IMPROVED ENHANCING EFFICIENCY

[75] Inventor: J. Michael Greenway, Westwood, Mass.

[73] Assignee: BBA Nonwovens Simpsonville, Inc., Simpsonville, S.C.

[21] Appl. No.: 08/985,947

[22] Filed: Dec. 5, 1997

[51] Int. Cl.[6] ..... D06B 1/02

[52] U.S. Cl. ..... 28/167; 28/104; 68/205 R

[58] Field of Search ..... 28/167, 163, 104, 28/105, 254, 273; 239/553, 553.3; 8/151, 158; 68/201, 205 R

[56] References Cited

U.S. PATENT DOCUMENTS

| | | | |
|---|---|---|---|
| 3,493,462 | 2/1970 | Bunting, Jr. et al. | 161/169 |
| 3,613,999 | 10/1971 | Bently et al. | 239/553.3 |
| 4,069,563 | 1/1978 | Contractor et al. | 28/105 |
| 4,094,468 | 6/1978 | Volle | 239/553 |
| 4,148,676 | 4/1979 | Paquette et al. | 28/103 |
| 4,157,605 | 6/1979 | Agers | 28/273 |
| 4,290,177 | 9/1981 | Price et al. | 28/254 |
| 4,323,760 | 4/1982 | Greenway et al. | 219/364 |
| 4,364,156 | 12/1982 | Greenway et al. | 26/2 R |
| 4,393,562 | 7/1983 | Stokes | 26/2 R |
| 4,471,514 | 9/1984 | Stokes | 26/2 R |
| 4,647,490 | 3/1987 | Bailey et al. | 428/131 |
| 4,880,168 | 11/1989 | Randall, Jr. et al. | 239/553.5 |
| 4,960,630 | 10/1990 | Greenway et al. | 28/104 |
| 4,967,456 | 11/1990 | Sternlieb et al. | 28/104 |
| 4,995,151 | 2/1991 | Siegel et al. | 26/69 |
| 5,035,031 | 7/1991 | Elliott | 26/69 R |
| 5,042,722 | 8/1991 | Randall, Jr. et al. | 239/553.5 |
| 5,148,583 | 9/1992 | Greenway | 26/2 R |
| 5,337,460 | 8/1994 | Cockfield et al. | 28/167 |
| 5,429,303 | 7/1995 | Winheim | 239/553 |
| 5,806,155 | 9/1998 | Malaney et al. | 28/104 |
| 5,822,835 | 10/1998 | Dischler | 28/167 |

*Primary Examiner*—Amy Vanatta

*Attorney, Agent, or Firm*—Ostrager Chong Flaherty & Onofrio

[57] ABSTRACT

An improved fabric hydroenhancement method provides for inducing turbulence in a fluid flow in a hydroenhancing manifold and applying the turbulent fluid flow to impinge on a row of orifices of a jet strip in a manifold, such that jet streams issuing from the jet orifices at an output end of the manifold are formed with a constant state of fluctuation in their cross-sectional shape, direction, and structure. This results in the jet streams distributing their delivered energy over constantly changing impact areas on the fabric, whereby more of the delivered energy is converted into enhancement energy for hydroenhancing the fabric. The turbulent hydroenhancing method is also found to obtain a significant reduction in fabric shrinkage, and also eliminates the generation of interference patterns in the fabric. Turbulence is induced by positioning a baffle below the distribution element in the manifold with its lower end in close proximity to the row of jet orifices. Various types of baffle designs may be used. A refined baffle design has a solid center portion and flow paths around its sides to smooth out uneven fluid flow caused by flow distribution structures in the manifold upstream of the jet orifices.

20 Claims, 19 Drawing Sheets

FIG. 6C
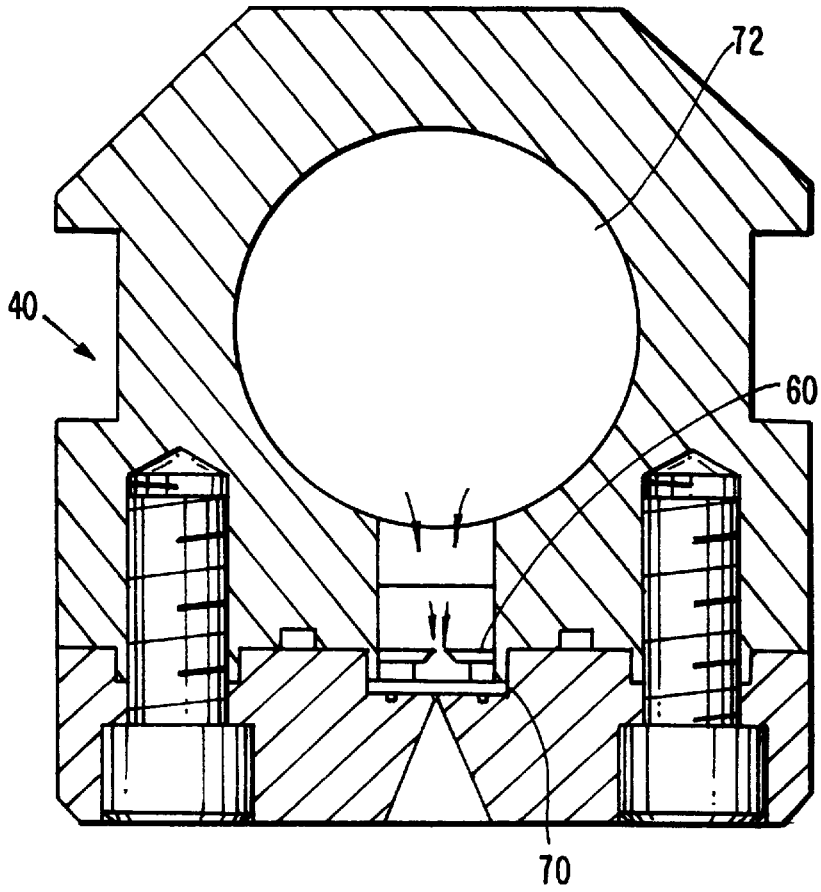
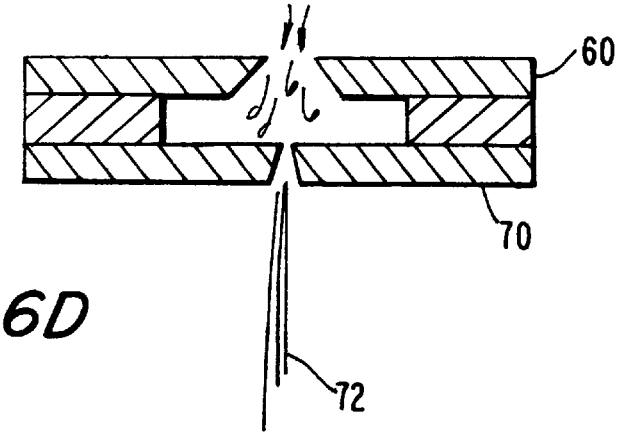
FIG. 6D

ENERGY (# PASSES) VS. AIR PERM
AIR PERM (cfm/sq.ft.)
100
80
60
40
2
4
8
16
32
64
100
PASSES
■ 1.0 HP R □ 1.0 HP T
◆ 0.5 HP R ◇ 0.5 HP T
▲ 0.25 HP R △ 0.25 HP T
● 0.125 HP R ○ 0.125 HP T

CONTROL

1HP HR/LB 2 PASSES 10FPM
REGULAR FLOW

1 HP HR/LB 2 PASSES 10 FPM
TURBULENT FLOW

TURBULENCE-INDUCED HYRDROENHANCING FOR IMPROVED ENHANCING EFFICIENCY

TECHNICAL FIELD

This invention generally relates to the field of hydroenhancing surface properties of textile fabric by subjecting it to hydrojet treatment, and more particularly, to improving the efficiency of fabric hydroenhancement methods and equipment.

BACKGROUND OF INVENTION

Prior hydroenhancement technology teaches that certain properties of woven or knitted fabrics, such as cover, yarn blooming, surface texture, hand, drape, etc., can be enhanced by impacting the surface of the fabric with rows of jet streams from a series of overhead manifolds as the fabric is conveyed on a support surface, as illustrated in FIG. 2, for example. Such conventional hydroenhancing equipment is described in greater detail in commonly-owned U.S. Pat. No. 4,967,456 of Sternlieb et al., issued on Nov. 6, 1990, entitled "Apparatus and Method For Hydroenhancing Fabric", which is incorporated herein by reference.

Generally, the conventional view has been that the degree of enhancement is related to the amount of energy imparted to the fabric. That is, the more energy delivered to the fabric, the more pronounced the enhancement effect. For example, U.S. Pat. No. 3,493,462 to Bunting teaches that the degree of surface treatment is related to the total energy E expended per weight of fabric in a pass under a hydrojet manifold, as calculated by the following equation:

E=0.125 (YPG/sb), in hp.-hr./lb. of fabric, where

Y=number of hydrojets (orifices) per linear inch of manifold,

P=pressure of fluid in the manifold, in p.s.i.g.,

G=volumetric flow of fluid in cu.ft./min. per orifice, s=speed of passage of fabric under the manifold, in ft./min., and b=weight of fabric treated, in oz./sq.yd.

This equation provided by Bunting is a standard calculation used in the industry for energy expended in the hydrotreatment of a fabric.

The degree of enhancement imparted to the surface of a fabric can be measured in terms of the cover of the fibers in the fabric. Cover has an inverse relation to the air permeability of the fabric, which is measured in cu.ft./min./sq.ft. (cfm/ft$^2$) . The graph in FIG. 1 illustrates the relationship, as known conventionally, between the amount of energy expended in hydrotreatment and the resulting air permeability property of the treated fabric. The graph shows that as the amount of energy expended (in hp-hr/lb) with each pass increases, the degree of enhancement, i.e., the cover of the fabric increases and, conversely, air permeability (in cfm/ft$^2$) decreases.

Conventional equipment for hydroenhancing fabric has employed high-speed processing lines having one or more manifolds in parallel across the width of fabric conveyed in a machine direction on a conveyor. Conventional techniques for obtaining suitable hydroenhancement of fabric include using high pressures of fluid jetted from the manifold, large-diameter jet orifices or lowered processing speeds to impact high energies of fluid per area of fabric per unit of time, and/or multiple manifold configurations. However, the requirements for handling high fluid pressures or fluid energies or multiple manifolds can increase the equipment size and complexity, as well as equipment and maintenance costs, significantly. The use of high total delivered energies, say in the range of 1.0 or 2.0 hp-hr/lb, is also less efficient, as improvements in fabric enhancement tend to taper off with further increases in energy. The use of high delivered energies can also cause greater fabric shrinkage, and can exacerbate the problem of interference patterns generated on the surface of the fabric by the impacting jet streams in relation to the yarn spacing in the fabric.

It is therefore a principal object of the present invention to improve the efficiency of fabric hydroenhancement by obtaining better fabric cover properties while decreasing the total energy expended in hydroenhancing. It is a further object of the invention to obtain improved fabric hydroenhancement while reducing the amount of fabric shrinkage due to enhancement. Another object of the invention is to reduce or eliminate the generation of interference patterns in hydroenhanced fabric. A further object is to provide improved equipment for fabric hydroenhancing that obtains these stated purposes.

SUMMARY OF INVENTION

In accordance with the present invention, an improved fabric hydroenhancement method is carried out by inducing turbulence in proximity to a row of jet orifices in a manifold for hydroenhancing fabric so that a turbulent stream impinges on the jet orifices and the jet streams issuing at an output end of the manifold are formed with a constant state of fluctuation in their cross-sectional shape, direction and structure. The fluctuating jets distribute their delivered energy over constantly changing impact areas on the fabric, whereby more of the delivered energy is converted into enhancement energy for hydroenhancing the fabric.

The turbulence-induced hydroenhancement method of the invention is also found to obtain a significant reduction in yarn shrinkage in the resultant fabric. For example, warp shrinkage can be reduced from a high of about 10% in regular hydroenhancing to about 2% in turbulence-induced hydroenhancing, and weft shrinkage from about 14% to about 6%. Turbulence-induced hydroenhancing can also reduce or eliminate the generation of interference patterns in the fabric, particularly when uniformity of turbulence across the row of jet orifices is obtained.

Turbulence is induced in a manifold by interposing a baffle below a fluid-receiving plenum and distribution element in the manifold and in proximity to the row of jet orifices at the output end. The baffle diverts the flow of fluid and creates turbulence in the fluid flow impinging on the row of jet orifices. Various types of baffle designs may be used. One baffle design is formed with a flat, rectangular plate having a plurality of small holes along its centerline. Another baffle design has two rails aligned in parallel to form a slot along its centerline that can be adjusted in width for optimal tuning of the turbulence induced in the manifold and, hence, the fluctuation and oscillation of the jets. Other baffle designs have openings for fluid flow along its sides and flow toward the center to improve uniformity in impinging the turbulent flow onto the jet orifices for elimination of interference patterns in the fabric.

Other objects, features, and advantages of the present invention are described in further detail below, having reference to the appended drawings:

BRIEF DESCRIPTION OF DRAWINGS

FIG. 6C shows the position of the baffle in the manifold, and FIG. 6D is a detailed view of the baffle creating turbulence in proximity to the jet orifices in the manifold.

DETAILED DESCRIPTION OF INVENTION

Figure 1:
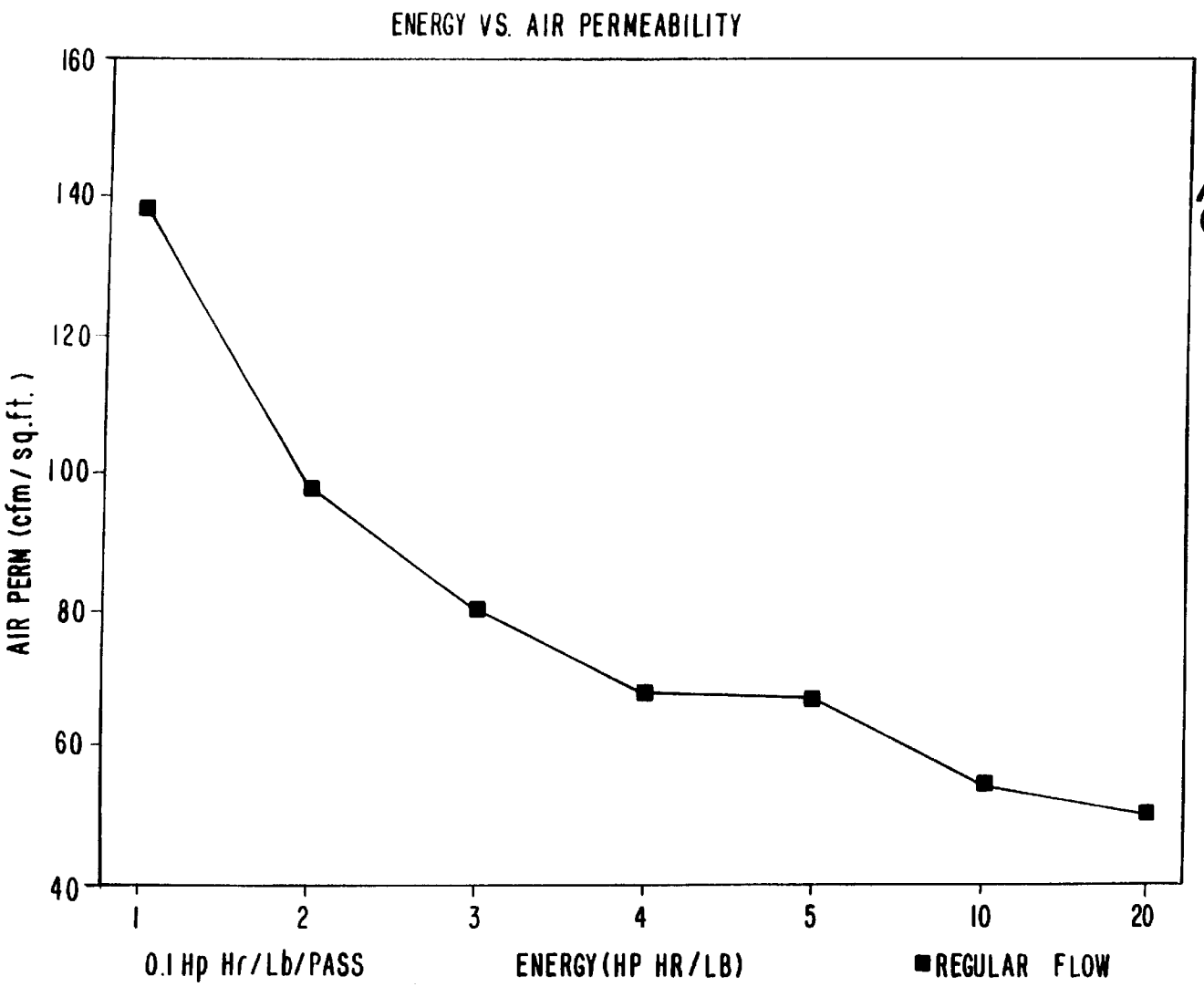
FIG. 1 (PRIOR ART)
FIG. 1 illustrates the relationship between the amount of energy expended in regular hydroenhancing and the resulting cover (measured in terms of air permeability) of the fabric.
Figure 2:
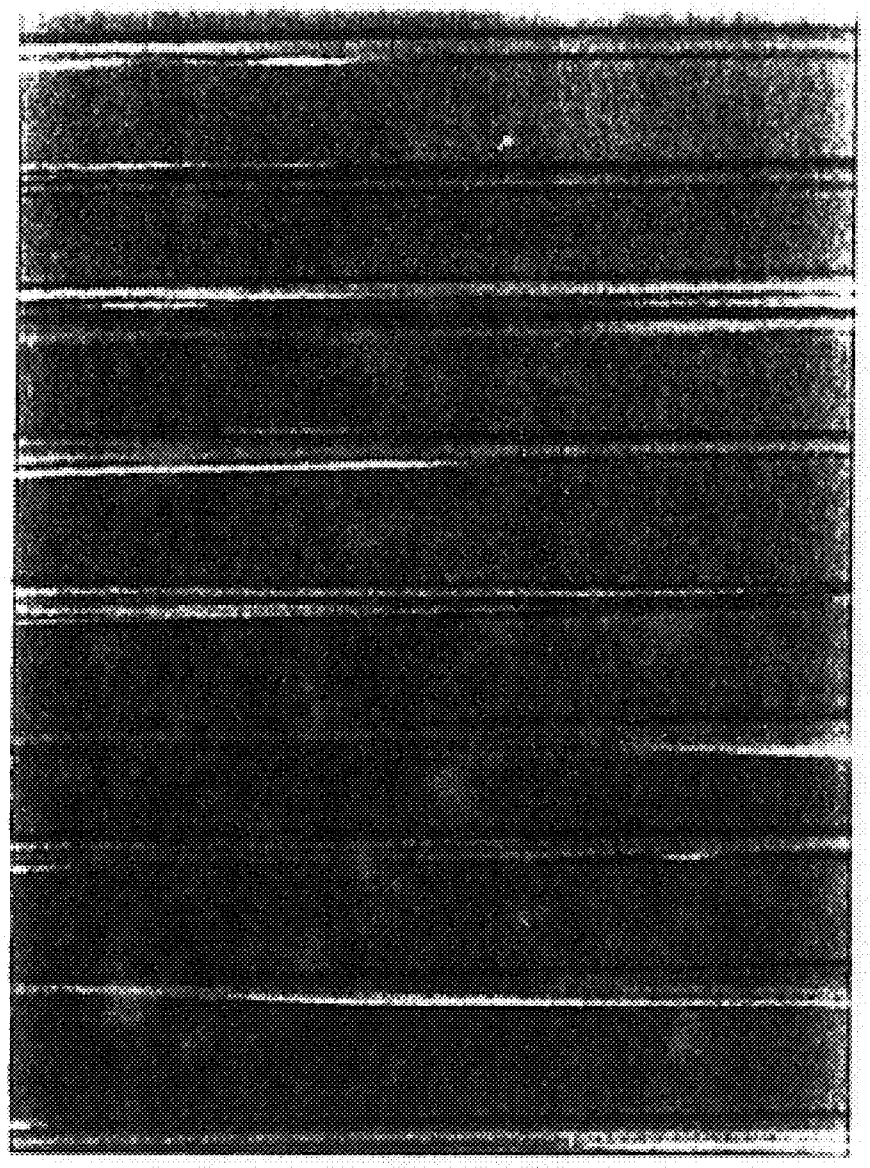
FIG. 2 is a magnified photograph showing that under regular flow conditions the jet streams issuing from circular orifices are not cylindrical as expected.

As shown in FIG. 2, the jet streams produced by regular flow in a manifold were found to occasionally take the form of randomly spiralling ribbons or streams which oscillate in their cross-sectional shapes when viewed over time. This occasional random fluctuation is believed to be caused by some degree of turbulence in the fluid flow in the manifold, perhaps due to the shape of the typical fluid-receiving and series of distribution holes which direct the fluid flow down to the jet orifices in the conventional manifold structure. In addition, some commercial manifold structures have a filter element interposed in the plenum or at the output side of the distribution holes to keep debris from clogging the jet orifices, and this may introduce some degree of turbulence in the fluid flow.

In the present invention, a fluid flow element is interposed below the distribution holes and in proximity to the jet orifices to create a flow pattern that will impinge on the jet orifices and cause the jet streams to issue with a constant state of fluctuation in their shape, direction, and structure. It is found that the constantly fluctuating jets obtain improvements in fabric cover (measured in terms of lower air permeability), reduced fabric shrinkage, and elimination of interference (moire) patterns in the fabric.

It is theorized that the impact of a jet stream on the fabric is capable of moving only an available amount of movable fibers in the impact zone when the jet stream first comes into contact with the fibers. Once the available movable fibers in the impact zone have been moved, the remainder of the delivered energy of the jet stream to the impact zone is essentially wasted until the impact zone is moved to a new location by the transport movement of the fabric relative to the manifold.

In accordance with the present invention, the jet stream is made to constantly move so that the area of its impact on the fabric is also constantly changing, and more of the delivered energy to the impact area is used to move other movable fibers. That is, constant spiralling rotation or oscillation of the jet stream increases the number of fibers that the jet can contact, and hence provides the jet with the opportunity to displace more fibers. The result is that the impact of their delivered energy is distributed over constantly changing impact areas on the fabric. The net effect is that more of the delivered energy is converted to enhancing energy, and improved hydroenhancing results are obtained without having to increase the amount of delivered energy to the fabric.

Figure 3A:
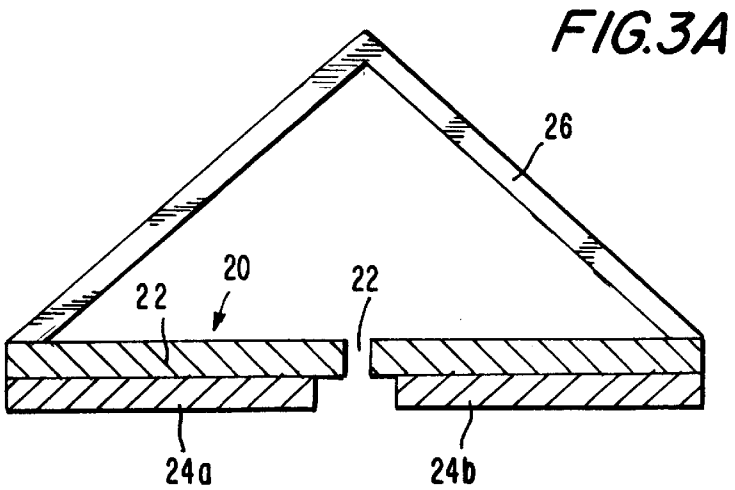
FIGS. 3A and 3B are plan and perspective views of one baffle design for inducing turbulence in a manifold for turbulence-induced hydroenhancing in accordance with the present invention.
Figure 3B:
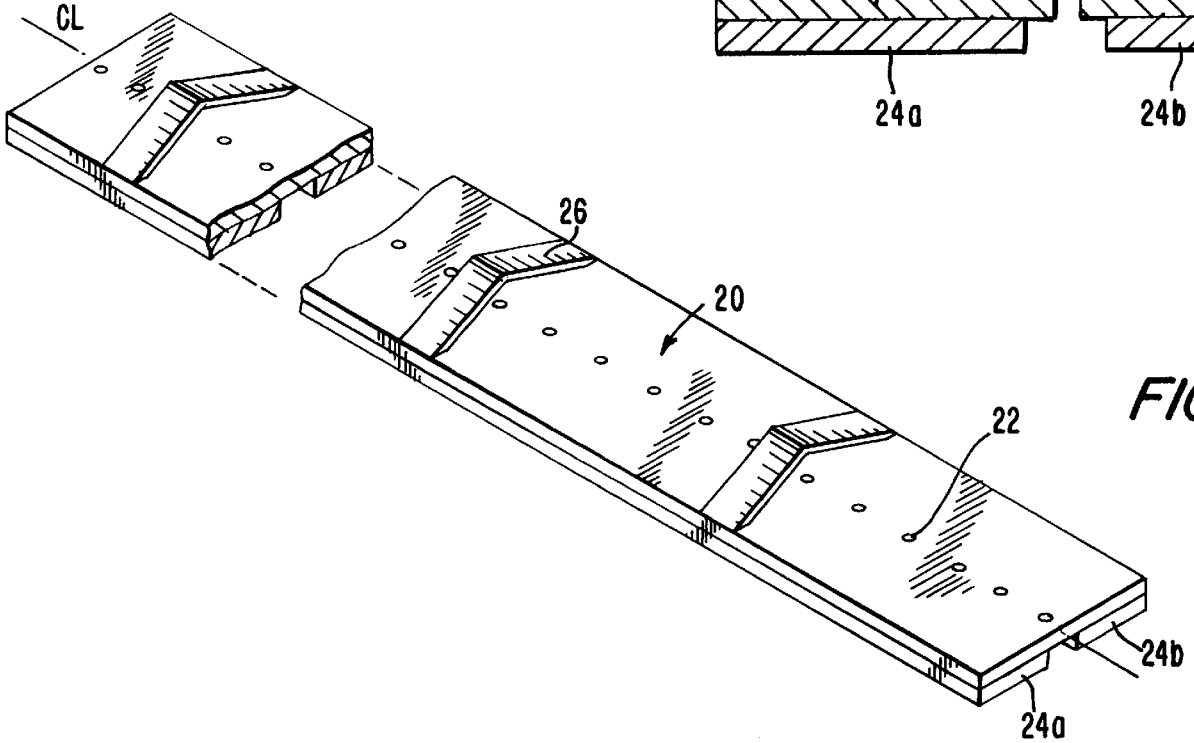

Constant spiralling rotation or oscillation in the jets can be generated by placing a baffle in the manifold directly above the row of orifices in the jet strip forming the jets. The baffle can have any type of design which is effective in creating a flow pattern with turbulence in the area around the jet orifices. As shown in FIGS. 3A and 3B, one design for a baffle has a flat rectangular plate 20 provided with a row of holes 22 along the centerline CL of the plate. In the drawing, this is simulated by superimposing a pair of spaced-part rails plates 24*a*, 24*b* on a stock-supplied perforated plate, so as to expose only the perforation holes along the centerline CL. Angle spacers 26 are provided at spaced intervals for positioning the baffle structure in the manifold. In trials conducted with this baffle design, a row of 0.045 inch diameter holes spaced on 0.062 inch centers was used.

Figure 3C:
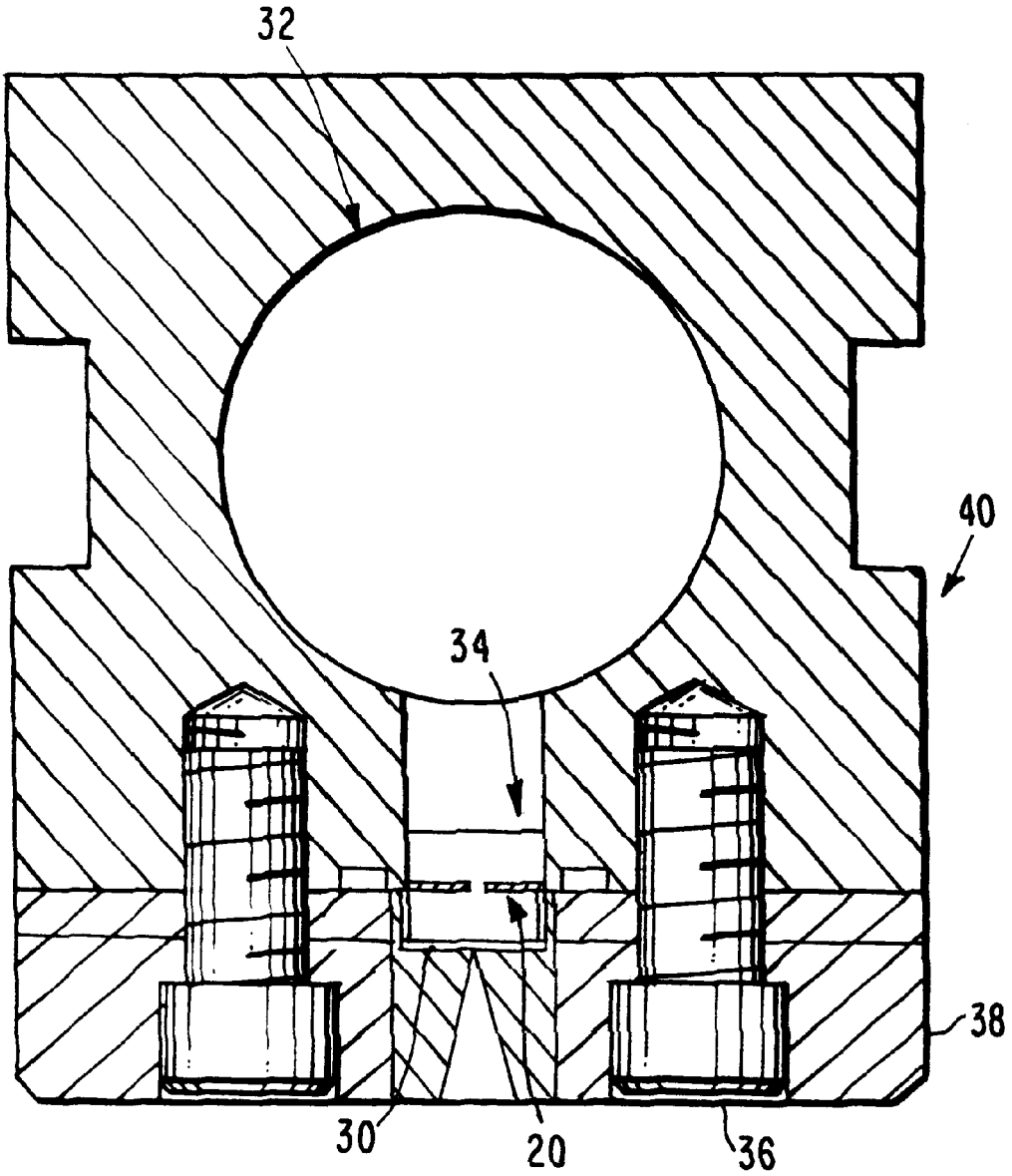
FIG. 3C shows the position of the baffle in the manifold.

In FIG. 3C, the baffle, indicated by numeral 20, is shown positioned in a manifold body 40 interposed in the fluid flow from an interior plenum 32 and distribution channels 34 to a jet strip 30 having a row of orifices at an output end of the manifold body. The jet strip 30 and baffle 20 are held in the manifold body by a support plate 38 bolted to the manifold body by bolts 36.

Figure 4:
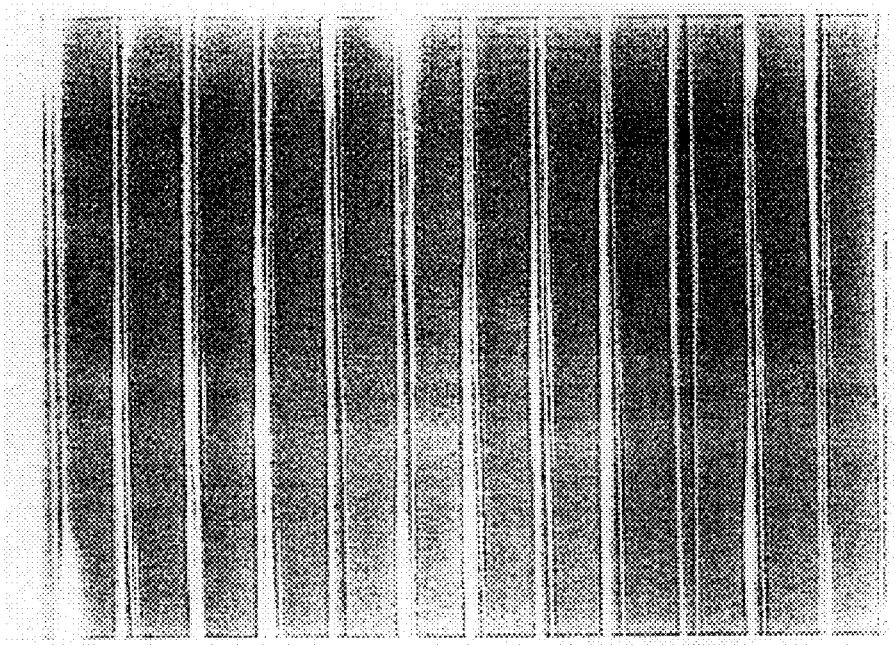
FIGS. 4 and 5 show a comparison of jet streams issued from a manifold having a regular fluid flow in contrast to a manifold having a baffle for inducing turbulence to generate jet streams of constantly changing cross-sectional shape and direction.
Figure 5:
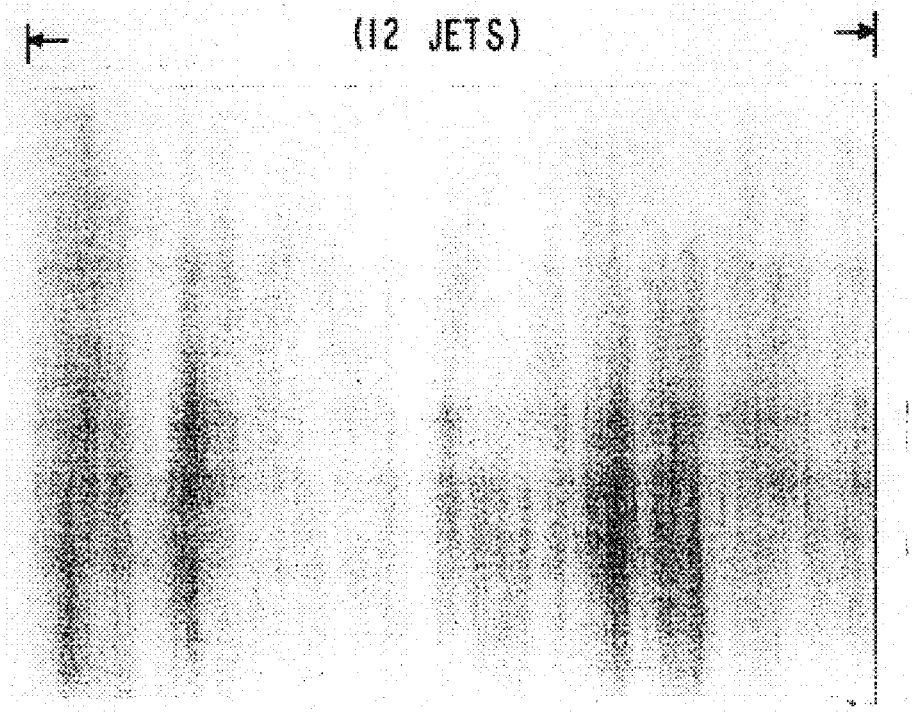
Figure 6A:
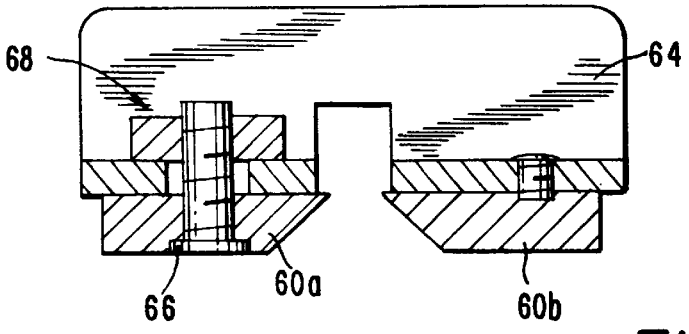
FIGS. 6A and 6B are plan and perspective views of another baffle design having an adjustable centerline slot for inducing turbulence in a manifold.
Figure 6B:
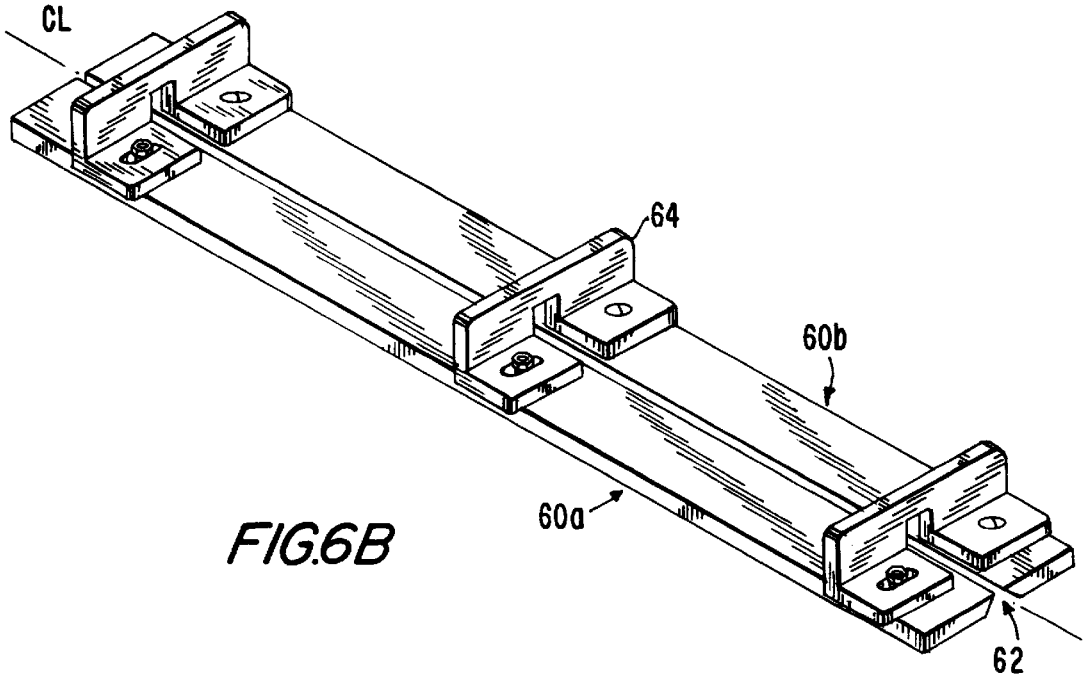

The effect of the baffle on the jet streams issuing from the row of orifices is illustrated comparatively in FIGS. 4 and 5. In FIG. 4, the jet streams from a manifold with regular fluid flow issue in the form of essentially columnar streams with a nominal amount of fluctuation in shape. In FIG. 5, the jet streams generated by the baffle have a high degree of oscillation such that they are almost completely broken up and there is almost no columnar jet formation. The high degree of jet oscillation produces constantly changing impact areas of the jets on the fabric for increased conversion of enhancing energy per unit area.

Another baffle design shown in FIGS. 6A–6D has two rails 60*a* and 60*b* aligned in parallel to form a slot 62 along its centerline CL for communicating the fluid flow to the row of jet orifices in the jet strip 70 held in the manifold body 40. One rail 60*b* is secured to spacers 64 in a fixed position, whereas the other rail 60*a* is adjustably secured to the spacers by bolt 66 and nut 68 so that it can be adjusted slightly in lateral position (indicated by the double-headed arrow in FIG. 6A) to vary the width of the slot 62.

This slot width adjustment allows the baffle 60 to be fine-tuned for the optimum jet oscillation (hence optimum enhancement of fabric). Too little turbulence can result in lower levels of enhancement and may not eliminate jet interference patterns, whereas too much turbulence can cause the jets to break up and reduce the energy delivered to the fabric. As shown in FIG. 6D, the baffle 60 creates turbulence in the fluid flow in a zone directly above the orifices of the jet strip 70 in order to impinge thereon and create constantly changing fluctuations in the jets 72. Placing the baffle too far above the jets might reduce the effect of the turbulence on the jets. Optimum results depend on the type of fabric being enhanced. The desired degree of constant jet fluctuation can be obtained by locating the lower plane of the baffle structure either right on top of the jet strip or by a close spacing of about 0.25 to 0.10 inch.

The baffle may be used with conventional hydroenhancing equipment, as well as with other types of improved hydroenhancing equipment as described in commonly owned U.S. patent application Ser. No. 08/986,132, entitled "Fabric Hydroenhancement Method And Equipment For Improved Efficiency", filed simultaneously herewith, which is incorporated herein by reference. The conventional hydroenhancement equipment employs one or several manifolds arranged in series for treating fabric conveyed at a given process speed beneath the manifold or manifold array. The improved hydroenhancement equipment employs conventional equipment at a high process speed in multiple passes, or a new reciprocating, oscillating, or rotating manifold for simulating multiple passes on the fabric.

Trials comparing fabric hydroenhancing obtained with regular fluid flow to turbulence-induced fluid flow were conducted using the manifold shown in FIG. 3C in conventional hydroenhancing equipment and the baffle shown in FIGS. 3A and 3B. The process speed and number of passes under the manifold were varied to simulate different total energy levels with different numbers of manifolds. The test fabric was Samuelson PFP Classic Style fabric made of polyester yarn (Trevira FR) with a basis weight of 158 grams/sq-yd (gsy). The jet strip had an orifice density of 60 jets/inch with 0.005 inch diameters, and the fluid pressure was 1500 psi.

Test results using the turbulence-inducing baffle (T) for total delivered energy from 0.125 to 1.0 hp-hr/lb and a range from 2 to 100 passes are summarized on Table 1 for regular fluid flow, and on Table 2 for turbulent fluid flow. An equal number of passes were applied to each side of the fabric, i.e., 4 passes are equal to 2 passes on each side. Additional test results for the turbulence-inducing baffle and regular flow for a delivered energy of 0.1 hp-hr/lb per pass over 1 to 20 passes are summarized on Table 3. The results are discussed below with respect to FIGS. 7–14.

Figure 7:
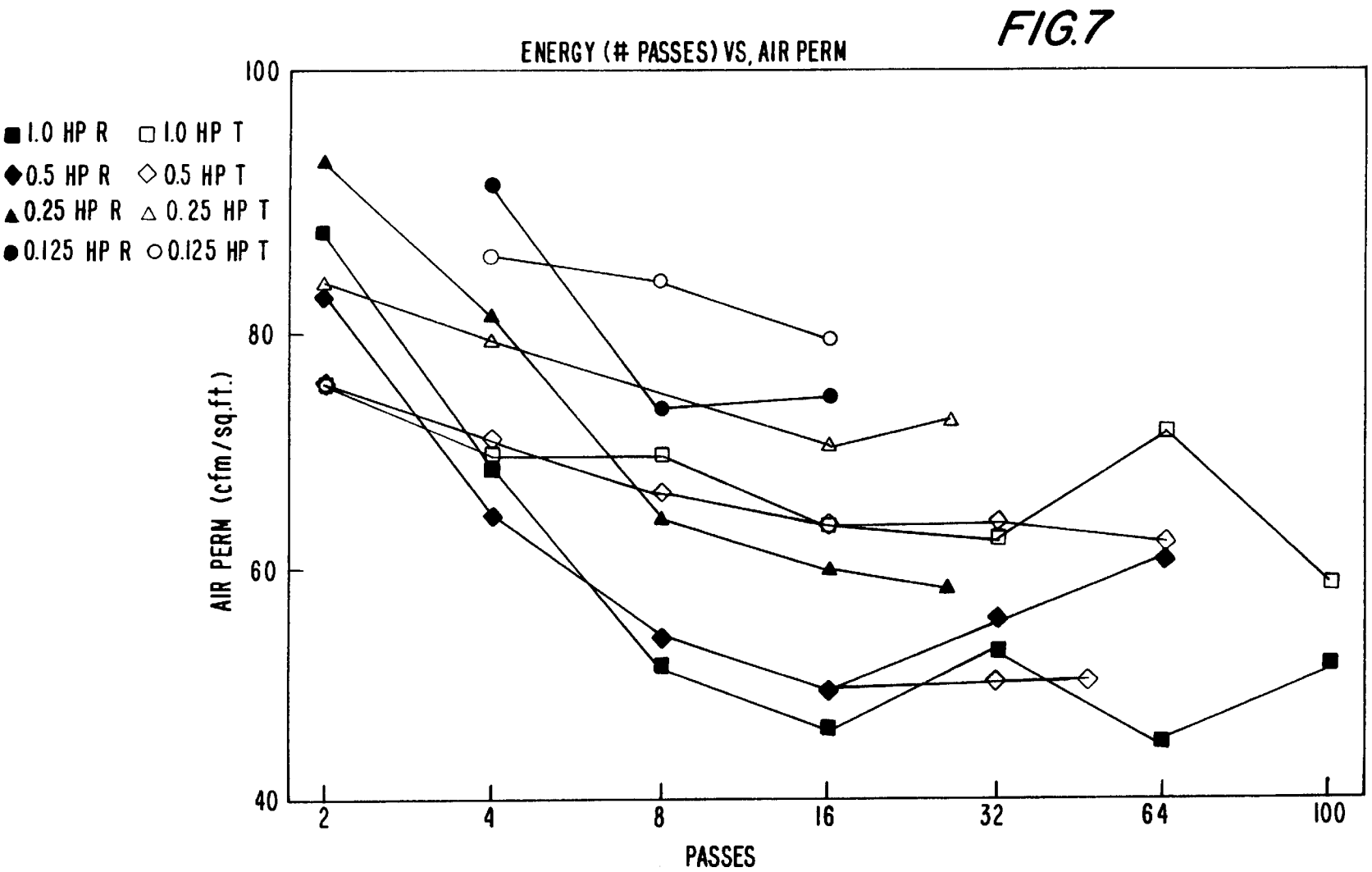
FIG. 7 is a graph showing fabric cover (measured in terms of air permeability) obtained at different levels of delivered energy as compared for regular hydroenhancing and turbulence-induced hydroenhancing versus the number of passes on the fabric.

In FIG. 7, the graph shows fabric cover (measured in terms of air permeability in cfm/sq-ft) versus the number of passes for total delivered energies ranging from 0.125 to 1.0 hp-hr/lb. Fabric enhanced with turbulent flow in 2 passes have about 10% to 20% lower air permeability, and hence a higher degree of enhancement, than fabric enhanced with regular flow, over all energy levels tested.

Figure 8:
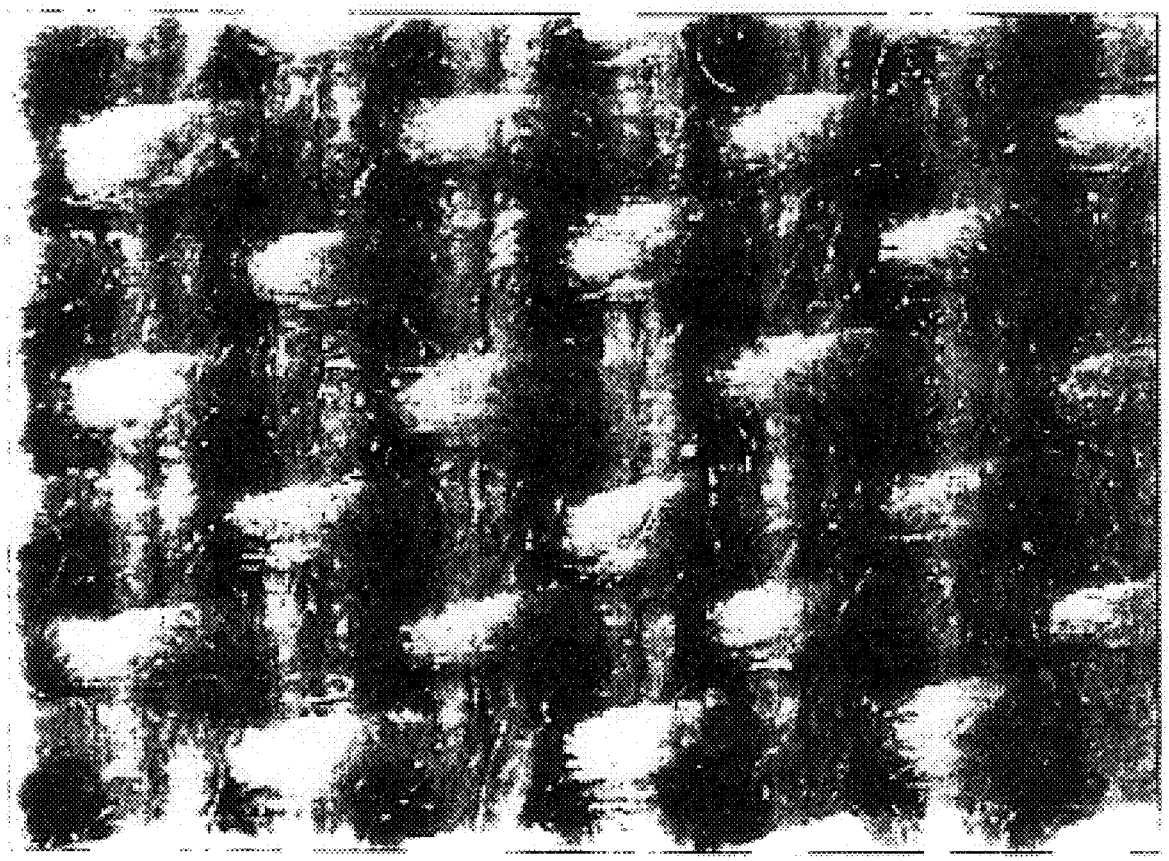
FIGS. 8, 9, and 10 are magnified photographs of fabric specimens showing a comparison of fabric cover without hydroenhancing (control), with regular hydroenhancing, and with turbulence-induced hydroenhancing.
Figure 9:
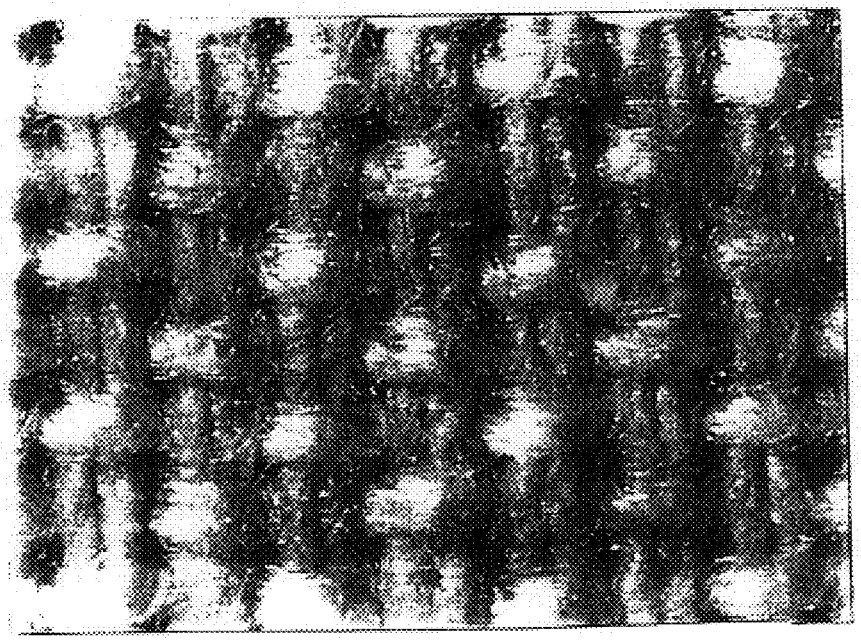
Figure 10:
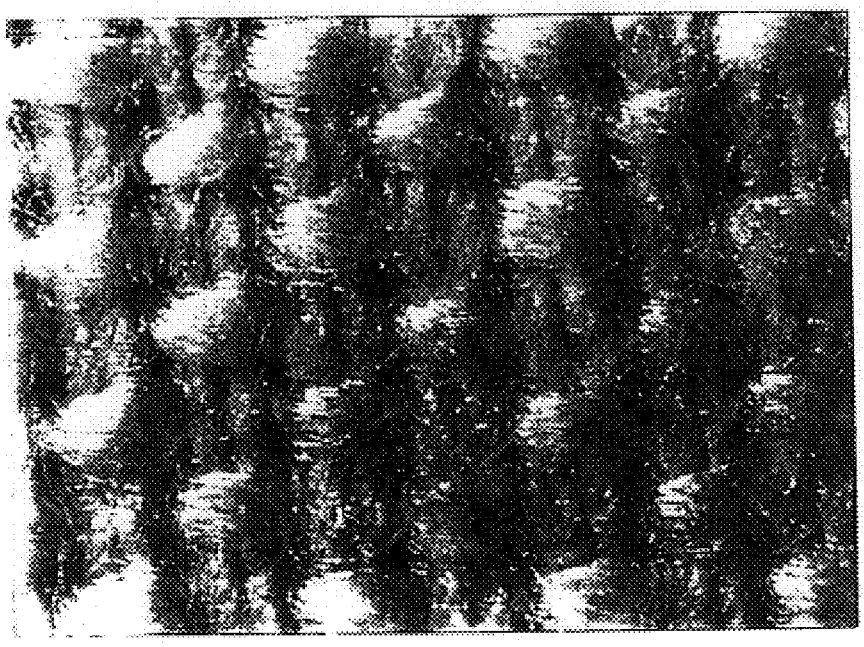

The effectiveness of enhancement with turbulent flow can be confirmed visually in FIGS. 8, 9, and 10 showing magnified photographs of fabric specimens without hydroenhancing (control), with regular hydroenhancing at 1.0 hp-hr/lb in 2 passes, and with turbulence-induced hydroenhancing at 1.0 hp-hr/lb in 2 passes, respectively. The effectiveness of the turbulent baffle on enhancement (air permeability) decreased when the number of passes was increased from 4 to 8 on up to 100, indicating that the turbulent enhancement method can be used for enhancing in a low number of passes and/or at low process speeds. At a high number of passes, the advantage of the turbulent baffle over regular flow is a decrease in fabric shrinkage due to enhancement.

Figure 11:
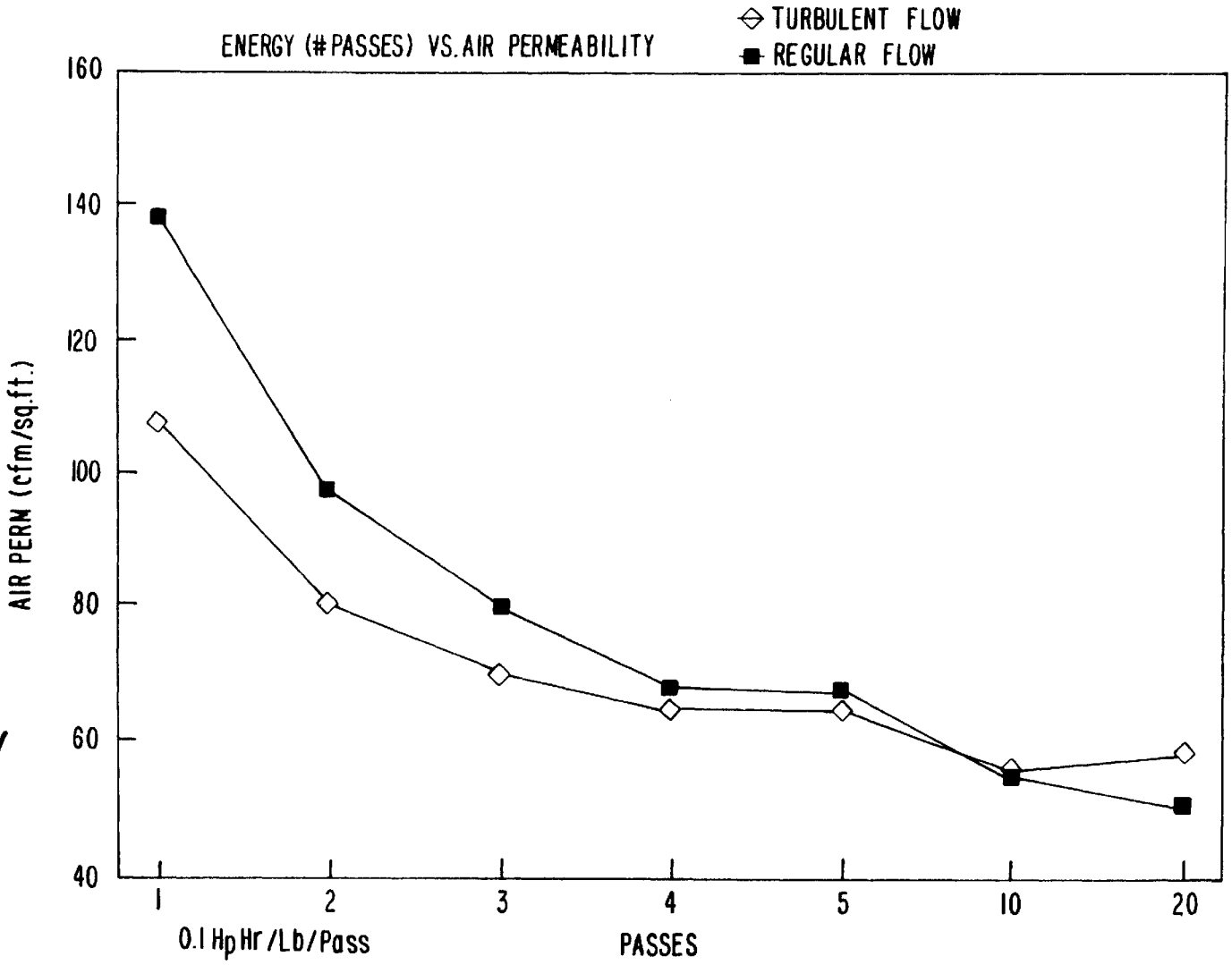
FIG. 11 is a graph showing fabric cover as compared for regular hydroenhancing and turbulence-induced hydroenhancing at 0.1 hp-hr/lb per pass versus the number of passes on the fabric.

The effect of the turbulent baffle on enhancement as compared to regular flow enhancement was confirmed using a single curtain of high pressure jets to impart 0.1 hp-lb/hr per pass over a range of 1 to 20 passes. FIG. 11 shows that use of the turbulent baffle obtained lower air permeability (hence superior enhancement) in a low number of from 1 to 4 passes, as compared to enhancing with regular flow. The superior enhancement was achieved at lower total energy levels (0.4 hp-hr/lb or less), indicating an improved hydroenhancing efficiency as compared to enhancing with regular flow.

Figure 12:
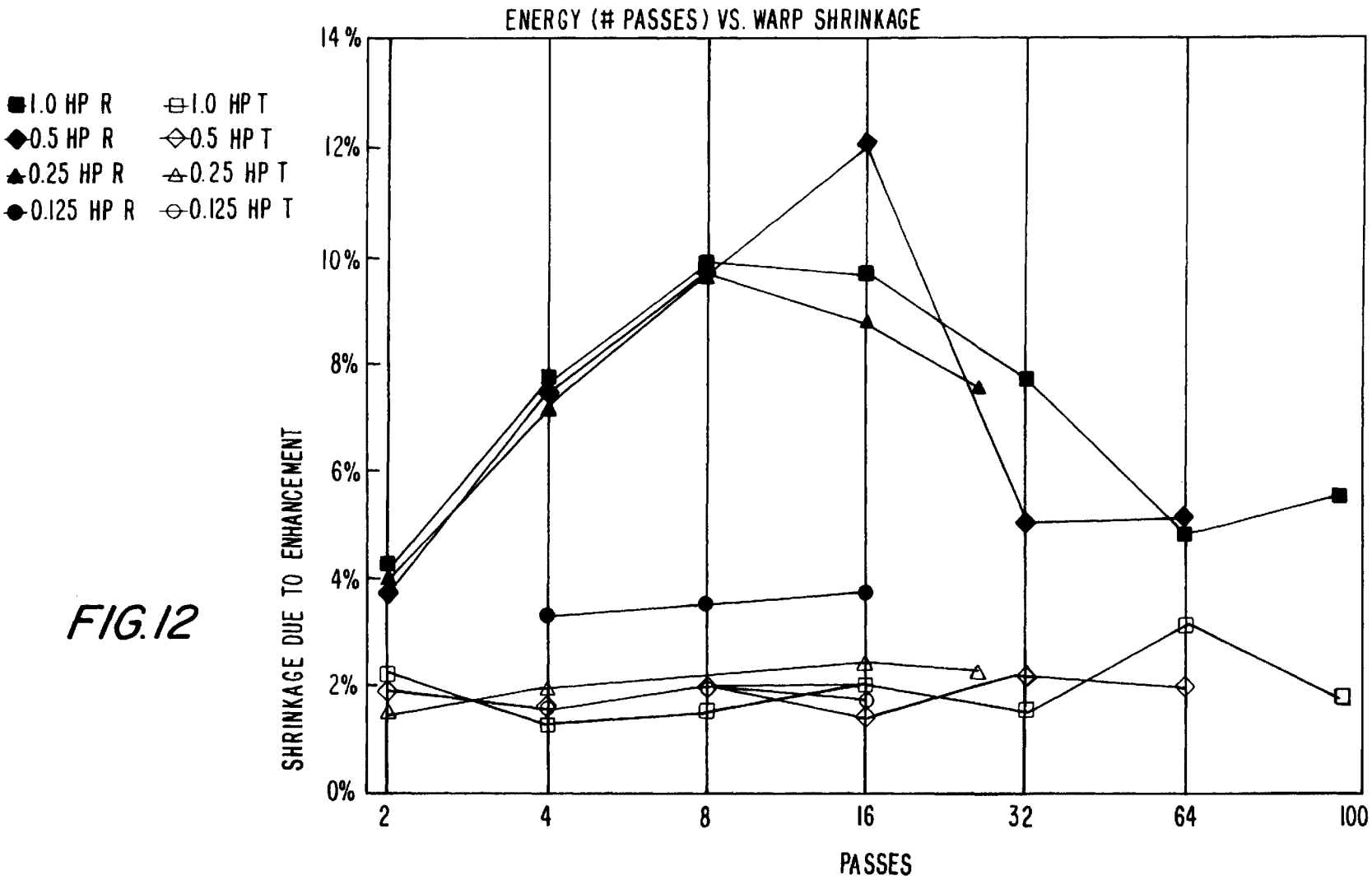
FIGS. 12, 13, and 14 are graphs showing warp and weft shrinkage (in percentages) as compared for regular hydroenhancing and turbulence-induced hydroenhancing versus the number of passes on the fabric.
Figure 13:
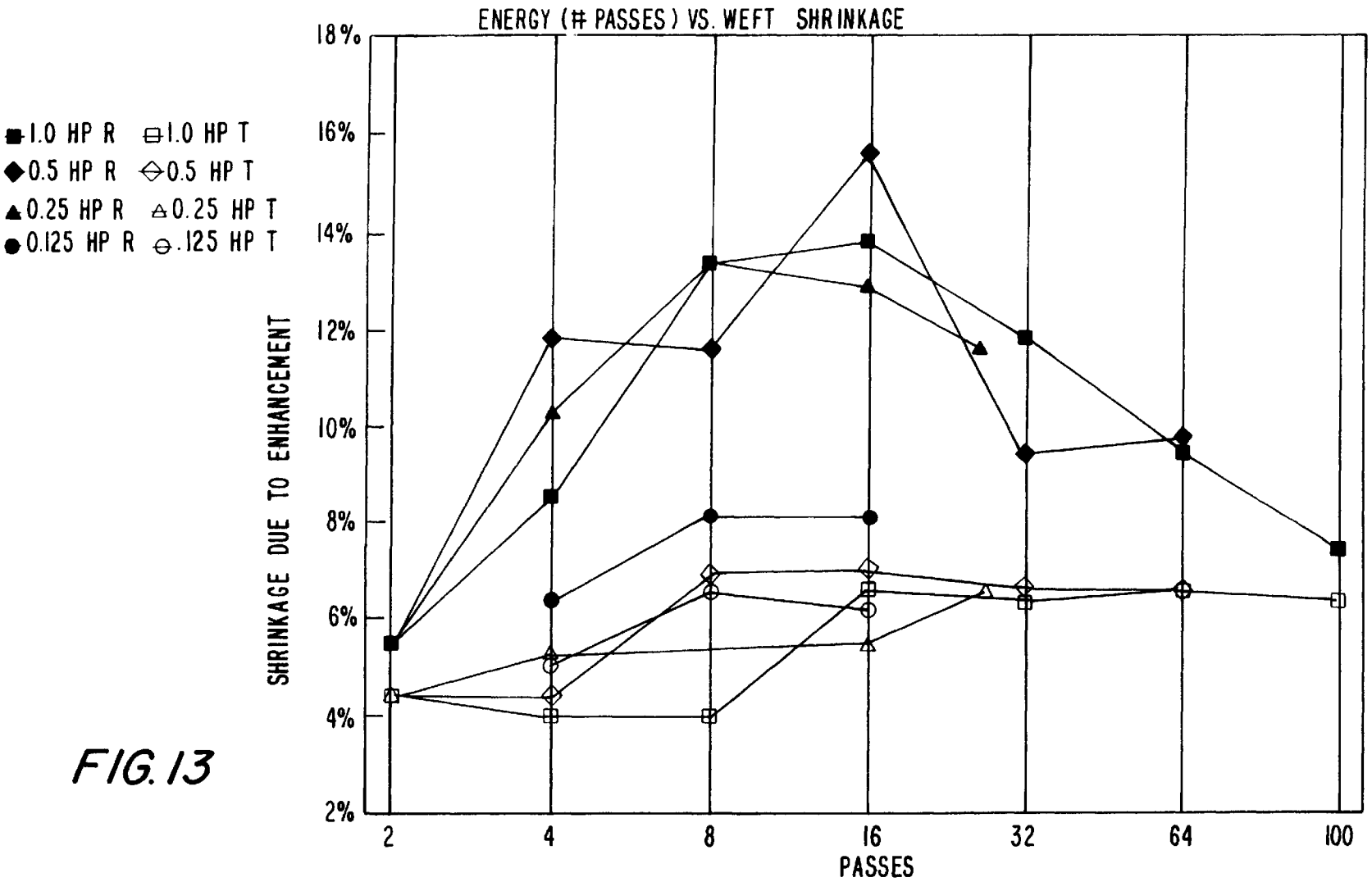

A certain amount of fabric shrinkage is normally associated with fabric hydroenhancement. It is theorized that yarn blooming from fluid impact causes the path of the fibers in the yarns to change, which in turn causes the length of yarns to shrink. A surprising result of hydroenhancement with turbulence-induced jets is a marked reduction in the shrinkage of fabrics. FIGS. 12 and 13 show that warp and weft yarn shrinkage for fabrics enhanced with the turbulent flow was far less than fabrics enhanced using regular flow, over an energy range of 0.125 to 1.0 hp-hr/lb and from 2 to 100 passes. Warp shrinkage was reduced from a high of about 10% in regular hydroenhancing to about 2% in turbulence-induced hydroenhancing, and weft shrinkage from about 14% to about 6%. The shrinkage reduction occurred at all energy levels tested.

Comparing this result to FIG. 7, the low shrinkage obtained using turbulent flow enhancing is a distinct advantage since enhancement is not decreased when the fabric is tentered out to its pre-enhancement width. When fabrics have a high shrinkage, a substantial amount of tentering is required to stretch the yarns, thereby reducing the level of bloom, and hence the level of enhancement.

Figure 14:
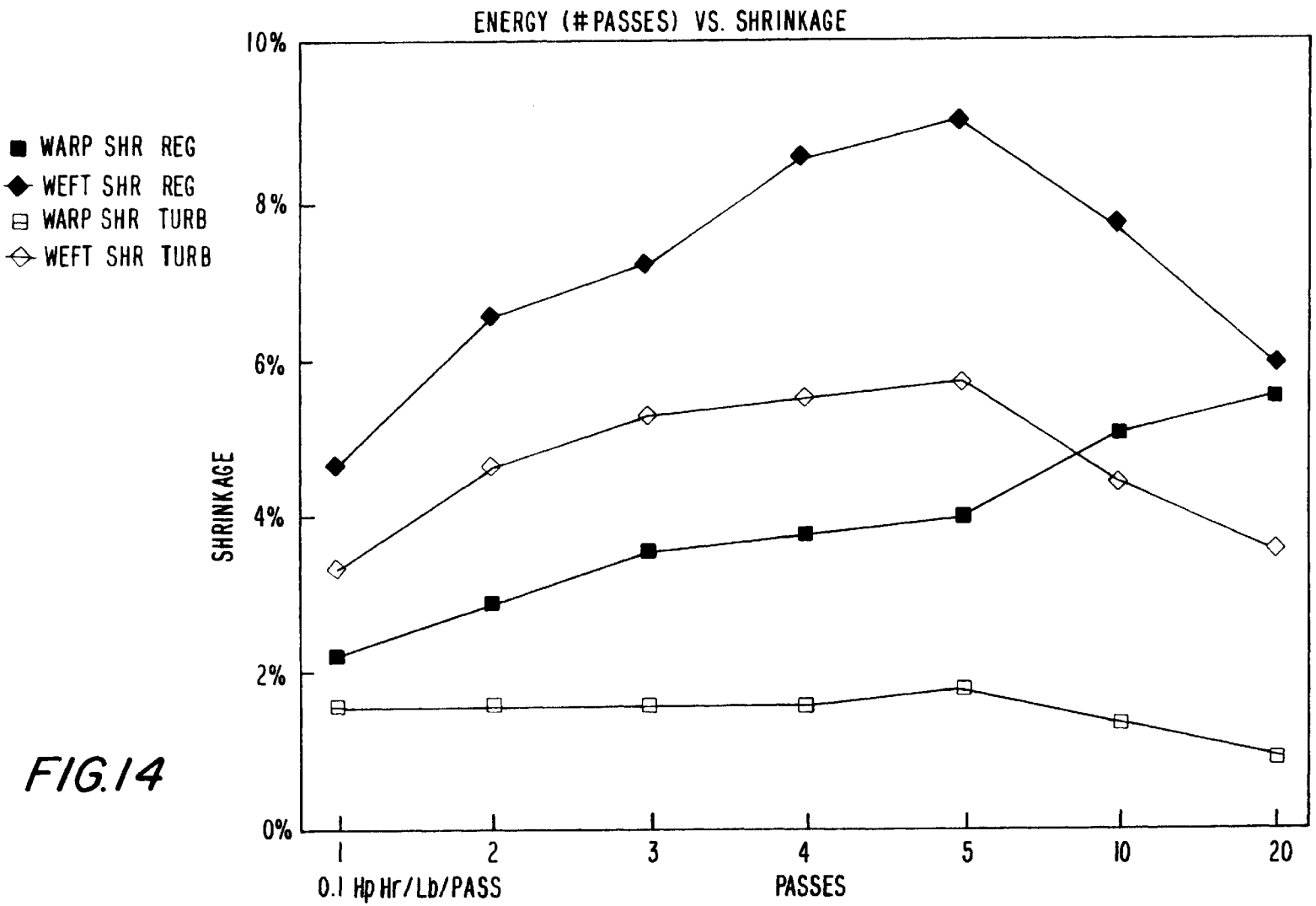

The reduced shrinkage effect of turbulent enhancement as compared to regular flow enhancement was confirmed using a single curtain of high pressure jets to impart 0.1 hp-lb/hr per pass over a range of 1 to 20 passes. FIG. 14 shows that significantly lower shrinkage was achieved over all total energy levels using turbulent enhancement.

Figure 19:
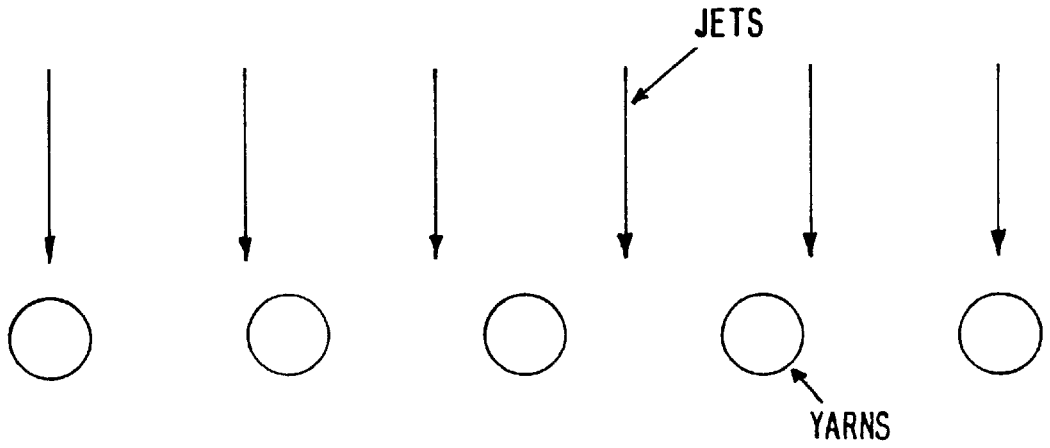
FIG. 19 is an illustration of how interference patterns are generated in hydroenhanced fabric due to the regular spacings of the jet streams and the yarns in the fabric.

Another advantage of the turbulent enhancing method is a reduction in the generation of interference (moire) patterns in the fabric. As illustrated in FIG. 19, the regular spacing of columnar jets can line up with the regular spacings of the yarn positions in the fabric, causing a pattern of closely spaced warp direction stripes to repeat across the fabric. With each pass under the jets, a new moire pattern is created. Jet strips having closely spaced jets can be used to eliminate moire on coarser fabrics, however this approach becomes impractical on fine weave fabrics.

By contrast, the constant oscillation or fluctuation of the jets in the present invention spreads the impact of the jets over a greater and constantly changing area on the fabric, and is found to substantially eliminate interference between the jet spacings and the warp yarns. In particular, the baffle design having the adjustable slot width shown in FIGS. 6A and 6B can be fine tuned to obtain the optimum degree of oscillation to eliminate moire.

Figure 15:
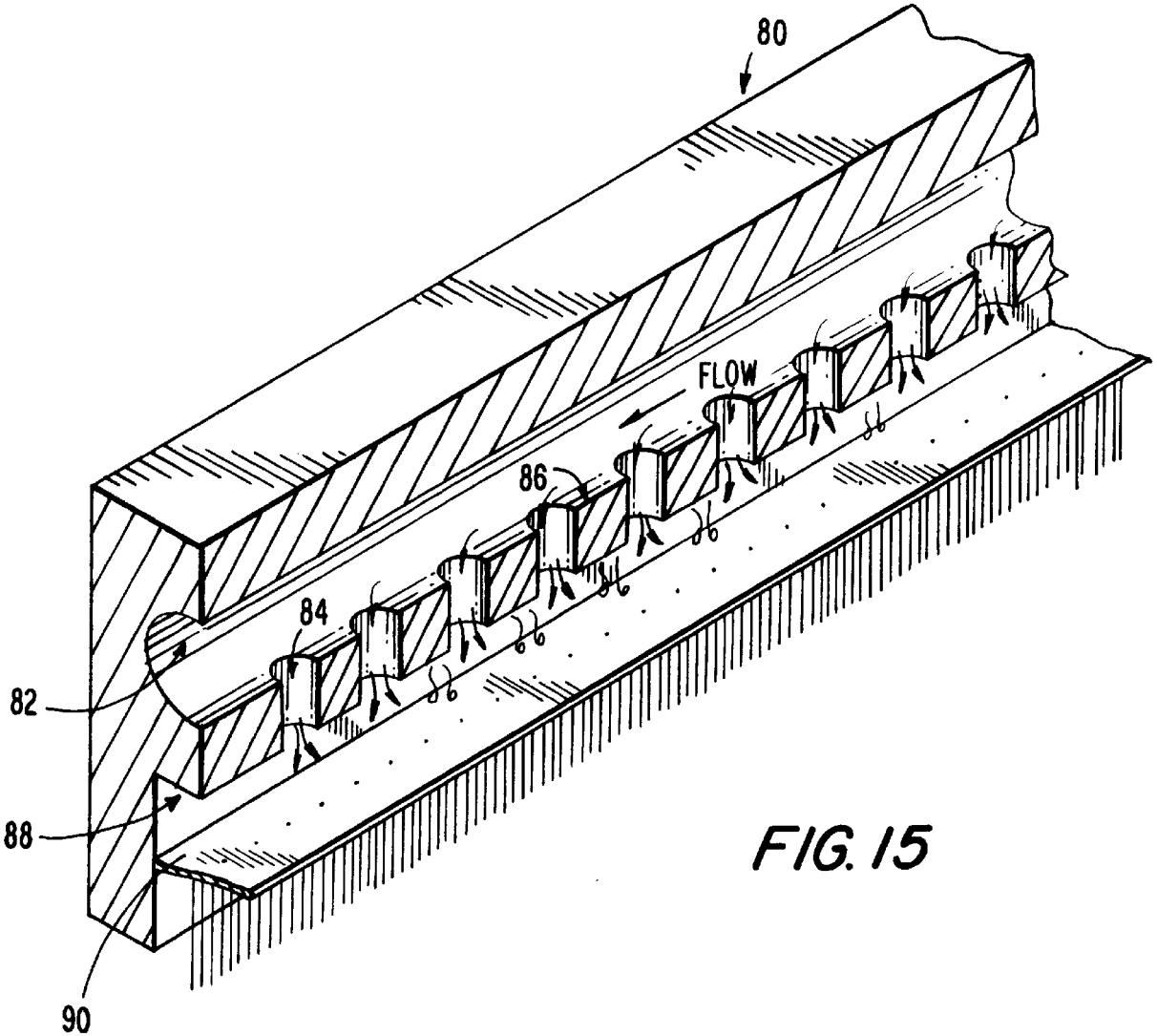
FIG. 15 is a schematic illustration of a conventional manifold in cross-section illustrating the problem of interference patterns caused by variations in the jet streams due to non-uniform turbulence in the manifold.

A further refinement of the present invention will also be described with respect to FIGS. 15–18. The creation of interference patterns or moire is undesirable in uniformly enhanced fabrics. It is found that widely spaced warp direction patterns can be caused by the structure of a conventional manifold. As depicted in FIG. 15, a conventional hydrojet manifold 80 has solid walls forming an interior plenum 82, a series of distribution channels 84 alternating with ligaments 86 of solid material between the channels for structural integrity and to enable the manifold to withstand high fluid pressures, and a lower plenum 88 in which a jet strip 90 provided with a row of orifices is secured at an output end of the manifold for issuing the jet streams. The distribution channels may have, for example, a diameter of 0.625 inch spaced on 1.0 inch centers, while the orifices have an 0.005 inch diameter spaced on 0.0164 centers. The flow velocity through the channels may be only 8.4 fps with insignificant pressure drop, whereas the flow through the jet orifices may be 290 fps at 1500 psi.

The flow of fluid into the channels 84 around the ligaments 86 can result in regions of higher turbulence downstream of the ligaments alternating with regions of lower turbulence directly downstream of the channels. As confirmed in close-up videography combined with high-speed strobe lighting, the differences in turbulence can result in more fluctuation in the spiralling structure of the jets downstream of the ligaments than those downstream of the channels, which results in spaced variations appearing as stripe patterns on the fabric. The solid ligament is believed to cause vortex shedding which creates higher turbulence and increased ribboning action in the jets downstream of it and, hence, slightly increases the level of hydroenhancement locally, which shows up as the widely spaced stripes described above.

Figure 16:
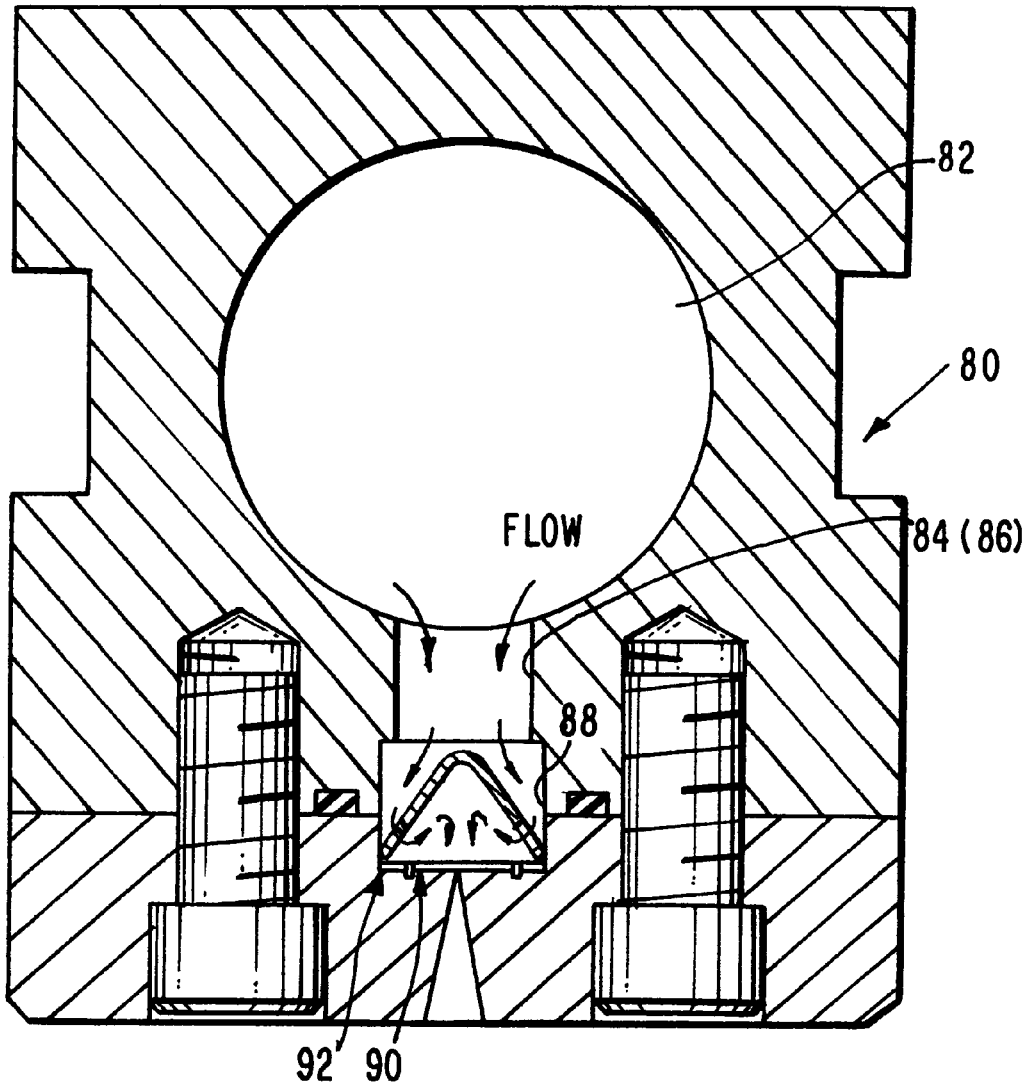
FIG. 16 is a schematic diagram in cross-section showing another baffle design for promoting low levels of uniform turbulence across the jet orifices in the manifold and overcoming flow variations upstream of the jets.

Another type of baffle design is provided to remove the turbulence differences caused by the ligament structures and provide a more uniform turbulent flow across the row of orifices. A more uniform vortex pattern over the length of the manifold ensures that the orifices form spiralling jets uniformly, thereby enhancing the fabric uniformly. As shown in FIG. 16, the baffle 92 has a solid center portion and flow-thru side portions such that the flow directly downstream of the channels 84 and ligatures 86 is redirected around the sides of the baffle, thereby smoothing out the areas of uneven turbulence downstream of the ligatures 86. The baffle 92 has a uniform, continuous structure along its length so that the resulting turbulence induced by the fluid flow around its sides to the turbulence zone above the jet strip 90 provides a uniform turbulent flow to the jet strip. This type of baffle would also be useful even in conventional hydroenhancing to eliminate interference patterns caused by the upper structure of the conventional manifold.

Figure 17B:
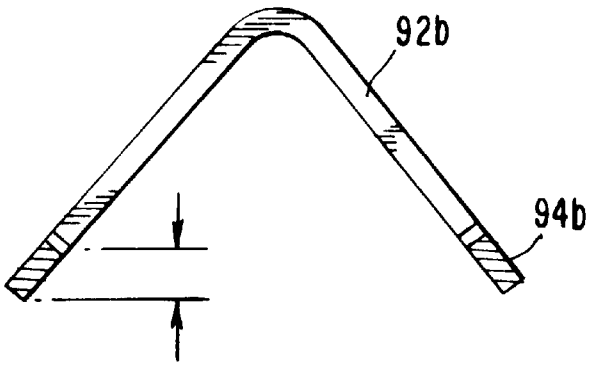
FIGS. 17A, 17B, and 17C show three variations of other baffle designs for promoting low levels of uniform turbulence across the jet orifices in the manifold and overcoming flow variations upstream of the jets.
Figure 17C:
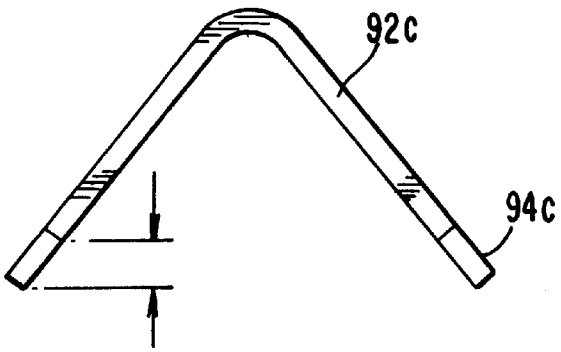
Figure 17A:
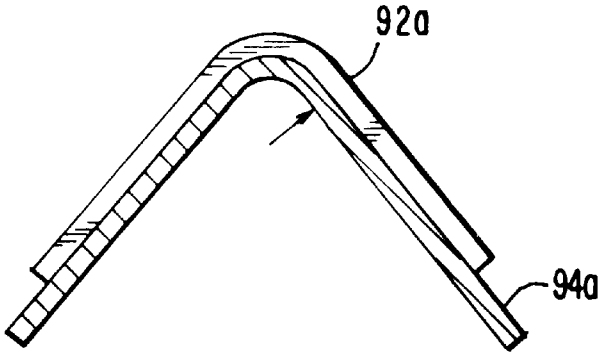

In FIGS. 17A, 17B, and 17C, three variations of the modified baffle design are shown. In FIG. 17A, the solid center is formed by a solid plate 92*a* that is bent at an angle on its centerline and spot welded onto a bent, stock-supplied, perforated plate 94*a*. The perforations on the edges of the perforated plate provide the flow paths at the sides of the baffle. In FIG. 17B, a single solid plate 92*b* has open sides and tabs 94*b* attached at intervals on its edges for holding the baffle in place in the manifold, while in FIG. 17C, a solid plate 92*c* is formed with castellations at intervals along its edges. The tabs or castellations should be offset from each other on opposite sides and of narrow dimensions, e.g., 0.10 to 0.18 inch, to prevent significant secondary vortexes from forming around them.

Figure 18A:
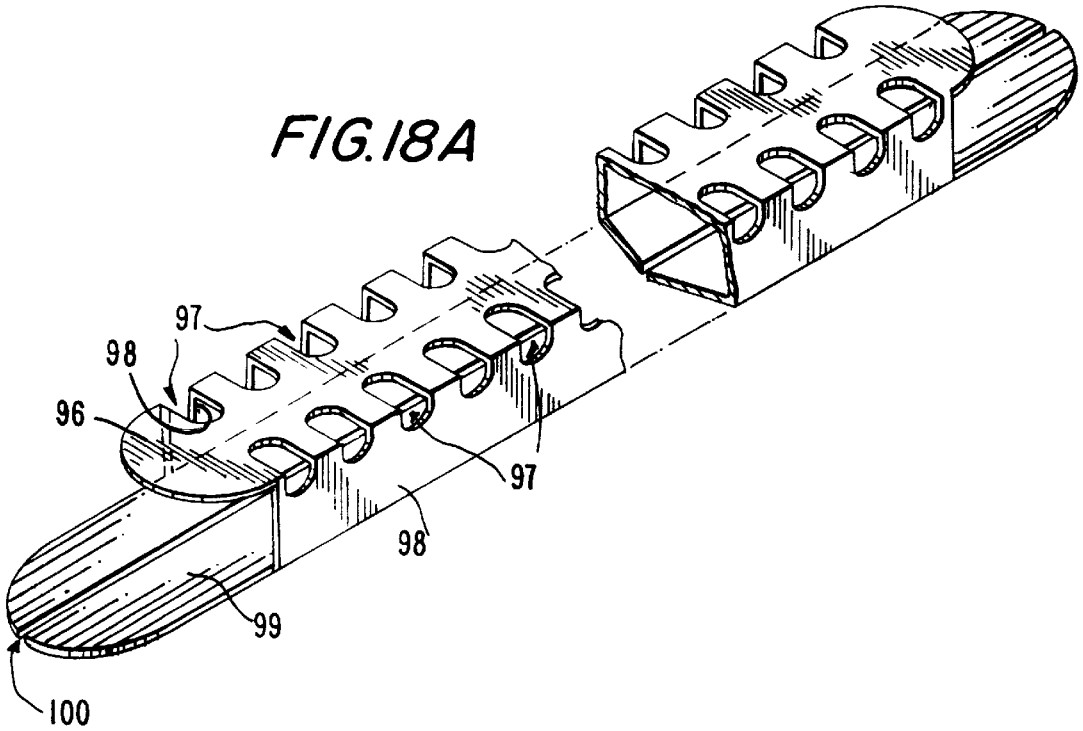
FIGS. 18A and 18B are perspective and sectional views of another baffle design for promoting low levels of uniform turbulence across the jet orifices in the manifold and overcoming flow variations upstream of the jets.
Figure 18B:
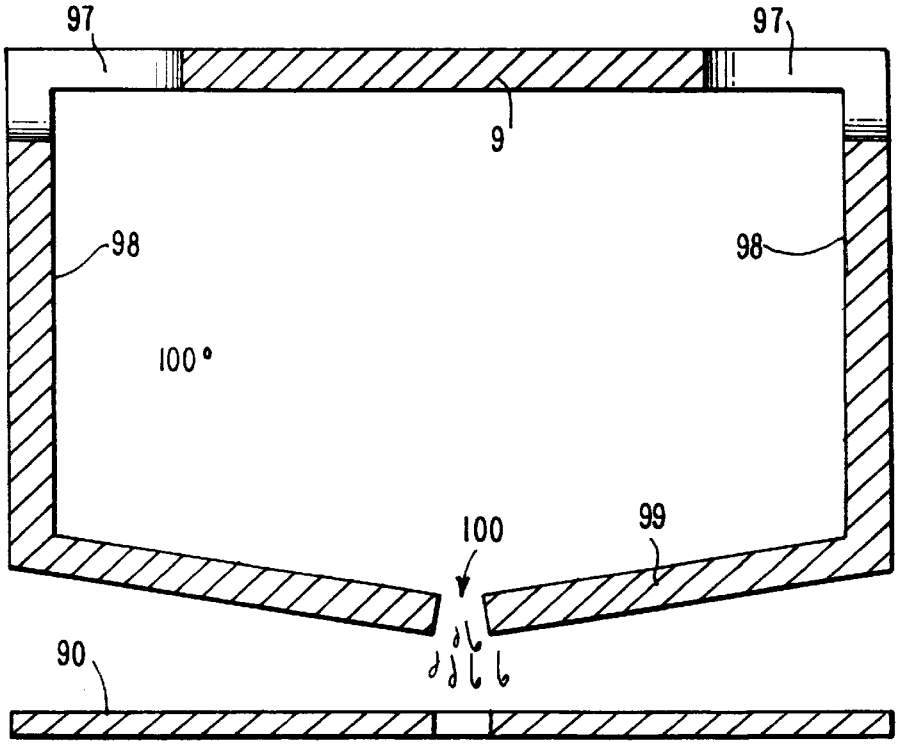

Another baffle design of the above type is shown in FIGS. 18A and 18B in perspective and sectional views. The baffle has a hollow box or channel shape formed by an upper wall 96 having openings 97 formed along itw two lengthwise sides, vertical side walls 98, and a lower wall 99 having a central slot 100 formed lengthwise and positioned directly above the row of orifices in the jet strip 90. The opposing lateral sides of the lower wall 99 are inclined downwardly toward the central slot, e.g., about at a 100° angle from the vertical, as shown in the drawing. Typical dimensions for the channel-shaped baffle include a width of about 0.72 inch, a height of about 0.47 inch, a central slot width of about 0.25 inch, and a spacing of the central slot above the row of jet orifices of about 0.10 inch.

The redirection of fluid flow to the openings along the sides of the baffle acts to smooth out uneven fluid flow caused by structures such as the distribution hole ligatures in the manifold upstream of the jets. The baffle slot produces a turbulent flow that impinges directly onto the row of jet orifices. The resulting fluctuating jet streams may be caused by vortices downstream of the slot 100, and are not necessarily the result of a high Reynolds number.

In general, the baffle design for creating turbulent flow has dimensions that encompass the length and width of the row of orifices in the jet strip, in order to ensure that the turbulence generated is applied across all of the jet orifices. The preferred location for the turbulent baffle for optimum results is directly above the row of jet orifices. A small turbulence zone may be provided between the baffle and the row of orifices as a mixing area for the turbulent fluid flow.

A further advantage provided by the turbulent baffle is the elimination of jet streaks on fabric caused by occasional problems in functioning of the jet orifices. Jet streaks can be caused when jets misfire due to wear or partial blockage of a jet orifice. Misalignment of a jet stream due to misfiring can cause it to combine with adjacent jet streams and produce a pronounced jet streak in the fabric. The streak may be only a surface effect or could be due to yarns being displaced by the combined force of the jets. A completely blocked jet may be less of a problem than a partially blocked jet since this will not cause yarns to be displaced and will only result in an unenhanced area on the fabric. While the hydroenhancing equipment's filtering system is designed to remove debris that could block jets, some jets will be affected by unremoved debris and could cause streaks.

The turbulent baffle can reduce or eliminate jet streaks caused by misfiring jets because the constant oscillation of the jet streams ensure that any tendency for misaligned jets to combine with adjacent jets is constantly being broken up. This was tested using an 18 jets/inch strip with 0.009 inch diameter holes. Due to the widely spaced, relatively large diameter holes, pronounced streaks would be produced in the fabric that are more severe than streaks caused by occasionally misfiring jets from a conventional 60 jets/inch strip with 0.005 inch diameter jets. A turbulent baffle placed above the 18 jets/inch strip caused constant oscillations across the row of jet streams which prevented them from causing streaks in the fabric. The oscillation of the jets could also reduce the unenhanced area of a blocked jet. Oscillation of the jets adjacent the blocked jet will tend to blend into and enhance the area that would normally be enhanced by the blocked jet.

Use of the turbulent baffle enables jet strips with widely spaced, large-diameter jet orifices to be used for hydroenhancing. The advantage here is that the larger diameter holes are more robust than the small diameter holes that are usually used, yet will not cause striping due to the constantly fluctuating shape and direction of the jet streams. The large diameter holes also require less filtration to protect them from blockages.

Further developments may be carried out to optimize the above-described methods and equipment for turbulent hydroenhancing. For example, the turbulent flow concept can be used to increase the efficient use of enhancement energy for enhancing at low energies per pass in a high number of passes. It may be adapted to conventional equipment operated at high process speeds in multiple passes, or to the aforementioned reciprocating or oscillating manifolds or manifold systems simulating multiple passes on the fabric. Turbulent flow can increase the amount of enhancement energy provided by each manifold or pass on the fabric, thereby increasing energy efficiency and reducing the required equipment and/or operational costs. The baffle design may also be fine tuned for optimal enhancement results. The principles of this invention may also be extended to improving the efficiency of hydroentanglement of fibers to form nonwoven fabric, which employs similar manifold and hydrojet equipment.

It is understood that many modifications and variations may be devised given the above description of the principles of the invention. It is intended that all such modifications and variations be considered as within the spirit and scope of this invention, as defined in the following claims.

TABLE 1

| | Control 12.1.93 | 8)12.16.93 | 8)12.09.93 | 9)12.09.93 | 10)12.09.93 | 11)12.09.93 | 1)12.21.93 | 2)12.23.93 |
|---|---|---|---|---|---|---|---|---|
| PSI | 0 | 1500 | 1500 | 1500 | 1500 | 1500 | 1500 | 1500 |
| Hp Hr/Lb | 0 | 1 | 1 | 1.25 | 1 | 1 | 1 | 1 |
| Passes | 0 | 2 | 4 | 8 | 16 | 32 | 64 | 100 |
| Speed | 0 | 10 | 19 | 31 | 77 | 154 | 308 | 488 |
| Baffle | 0 | R | R | R | R | R | R | R |
| Weight (gsy) | 157.62 | 170.34 | 180.36 | 194.38 | 194.84 | 182.86 | 167.02 | 173.02 |
| Weight (osy) | 5.56 | 6.01 | 6.36 | 6.86 | 6.87 | 6.45 | 5.89 | 6.10 |
| Thickness (mils) | 34.1 | 33.5 | 32.7 | 33.8 | 34.6 | 33.7 | 31.7 | 30.5 |
| Air Perm (cfm/sq.ft.) | 261 | 88 | 68.00 | 50.74 | 45.58 | 52.19 | 63.83 | 51.15 |
| WARP Shrinkage due to enhancement | | 4.16% | 7.66% | 9.85% | 9.63% | 7.66% | 4.81% | 5.47% |
| WEFT Shrinkage | | 5.47% | 8.53% | 13.35% | 13.79% | 11.82% | 9.41% | 7.44% |

| | 10)12.16.93 | 16)12.09.93 | 17)12.09.93 | 18)12.01.93 | 19)12.09.93 | | 19)12.23.93 |
|---|---|---|---|---|---|---|---|
| PSI | 1500 | 1500 | 1500 | 1500 | 1500 | | 1500 |
| Hp Hr/Lb | 0.25 | 0.25 | 0.25 | 0.25 | 0.25 | | 0.125 |
| Passes | 2 | 4 | 8 | 16 | 32 | | 4 |
| Speed | 38 | 77 | 154 | 308 | 488 | | 154 |
| Baffle | R | R | R | R | R | | R |
| Weight (gsy) | 170.01 | 177.15 | 188.27 | 181.57 | 181.63 | | 171.72 |
| Weight (osy) | 6.00 | 6.25 | 6.64 | 6.40 | 6.41 | | 6.06 |
| Thickness (mils) | 33.5 | 33.1 | 33.6 | 32.8 | 33.3 | | 32.4 |
| Air Perm (cfm/sq.ft.) | 94 | 81.00 | 63.76 | 59.22 | 57.32 | | 92 |
| WARP Shrinkage due to enhancement | 3.94% | 7.22% | 9.63% | 8.75% | 7.44% | | 3.28% |
| WEFT Shrinkage | 5.47% | 10.28% | 13.35% | 12.91% | 11.60% | | 6.35% |

| | 9)12.16.93 | 12)12.01.93 | 13)12.09.93 | 14)12.09.93 | 15)12.09.93 | 3)12.23.93 |
|---|---|---|---|---|---|---|
| PSI | 1500 | 1500 | 1500 | 1500 | 1500 | 1500 |
| Hp Hr/Lb | 0.5 | 0.625 | 0.5 | 0.5 | 0.5 | 0.5 |
| Passes | 2 | 4 | 8 | 16 | 32 | 50 |
| Speed | 19 | 31 | 77 | 154 | 308 | 488 |
| Baffle | R | R | R | R | R | R |
| Weight (gsy) | 172.28 | 191.47 | 197.23 | 196.47 | 180.13 | 173.05 |
| Weight (osy) | 6.08 | 6.75 | 6.96 | 6.93 | 6.35 | 6.10 |
| Thickness (mils) | 33.5 | 33.5 | 33.5 | 33.5 | 33.7 | 31.3 |
| Air Perm (cfm/sq.ft.) | 83 | 64.12 | 53.44 | 48.99 | 54.91 | 60.61 |
| WARP Shrinkage due to enhancement | 3.72% | 7.44% | 9.63% | 12.04% | 5.03% | 5.03% |
| WEFT Shrinkage | 5.47% | 11.82% | 11.60% | 15.54% | 9.41% | 9.63% |

| | 20)12.23.93 | 21)12.23.93 | REPEAT 18)2.17.94 | REPEAT 19)2.17.94 | REPEAT 20)2.17.94 |
|---|---|---|---|---|---|
| PSI | 1500 | 1500 | 1500 | 1500 | 1500 |
| Hp Hr/Lb | 0.125 | 0.125 | 1 | 0.5 | 0.5 |
| Passes | 8 | 12 | 64 | 50 | 32 |
| Speed | 308 | 488 | 308 | 488 | 308 |
| Baffle | R | R | R | R | R |

TABLE 1-continued

| | | | | | |
|---|---|---|---|---|---|
| Weight (gsy) | 174.52 | 171.87 | 181.22 | 177.06 | 179.54 |
| Weight (osy) | 6.16 | 6.06 | 6.39 | 6.25 | 6.33 |
| Thickness (mils) | 32.3 | 32.2 | 32.5 | 31.2 | 32.4 |
| Air Perm (cfm/sq.ft.) | 73 | 74 | 44.54 | 49.09 | 48.95 |
| WARP Shrinkage due to enhancement | 3.50% | 3.72% | 4.16% | 3.72% | 4.16% |
| WEFT Shrinkage | 8.10% | 8.10% | 10.72% | 9.85% | 9.63% |

NOTE: "R" IN THE BAFFLE ROW REFERS TO "REGULAR FLOW".

TABLE 2

| | | | | | | | |
|---|---|---|---|---|---|---|---|
| Hp Hr/Lb | 1 | 1 | 1 | 1 | 1 | 1 | 1 |
| Passes | 2 | 4 | 8 | 16 | 32 | 64 | 100 |
| Speed | 10 | 19 | 38 | 77 | 154 | 308 | 488 |
| Baffle | T | T | T | T | T | T | T |
| Weight (gsy) | 165.32 | 161.51 | 163.83 | 165.48 | 163.85 | 161.95 | 166.17 |
| Weight (osy) | 5.83 | 5.70 | 5.78 | 5.84 | 5.78 | 5.71 | 5.86 |
| Thickness (mils) | 35.5 | 34.6 | 33.3 | 32.7 | 31.9 | 30.4 | 32.2 |
| Air Perm (cfm/sq.ft.) | 75 | 69 | 69 | 63.02 | 62 | 71 | 58 |
| Air perm grams | 75 | 68 | 69 | 63 | 62 | 70 | 58 |
| WARP Shrinkage due to enhancement | 2.19% | 1.31% | 1.53% | 1.97% | 1.53% | 3.06% | 1.75% |
| WEFT Shrinkage | 4.38% | 3.94% | 3.94% | 6.56% | 6.35% | 6.56% | 6.35% |
| | 13)12.16.93 | 12)12.23.93 | 13)12.23.9 | 14)12.23.93 | 15)12.23.93 | | |
| Hp Hr/Lb | 0.25 | 0.25 | 0.25 | 0.25 | 0.25 | | |
| Passes | 2 | 4 | 8 | 16 | 24 | | 2 |
| Speed | 38 | 77 | 154 | 308 | 488 | | |
| Baffle | T | T | T | T | T | | |
| Weight (gsy) | 164.56 | 165.1 | | 167.56 | 167.68 | | |
| Weight (osy) | 5.80 | 5.82 | | 5.91 | 5.91 | | |
| Thickness (mils) | 32.9 | 31.2 | | 30.3 | 30.8 | | |
| Air Perm (cfm/sq.ft.) | 84 | 79 | | 70 | 72 | | |
| Air perm grams | 13823 | 13043 | | 11729 | 12073 | 0 | 0 |
| WARP Shrinkage due to enhancement | 1.53% | 1.97% | | 2.41% | 2.19% | | |
| WEFT Shrinkage | 4.38% | 5.25% | | 5.47% | 6.56% | | |
| Hp Hr/Lb | | 0.5 | 0.5 | 0.5 | 0.5 | 0.5 | 0.5 |
| Passes | | 2 | 4 | 8 | 16 | 32 | 50 |
| Speed | | 19 | 38 | 77 | 154 | 308 | 488 |
| Baffle | | T | T | T | T | T | T |
| Weight (gsy) | | 166.84 | 163.25 | 167.20 | 167.47 | 168.11 | 166.12 |
| Weight (osy) | | 5.89 | 5.76 | 5.90 | 5.91 | 5.93 | 5.86 |
| Thickness (mils) | | 34.2 | 32.8 | 31.7 | 32.0 | 31.5 | 31 |
| Air Perm (cfm/sq.ft.) | | 75 | 70 | 66 | 63 | 63 | 61 |
| Air perm grams | | 76 | 69 | 67 | 64 | 64 | 61 |
| WARP Shrinkage due to enhancement | | 1.97% | 1.53% | 1.97% | 1.53% | 2.19% | 1.97% |
| WEFT Shrinkage | | 4.38% | 4.38% | 6.78% | 7.00% | 6.56% | 6.56% |
| | 16)12.23.93 | 17)12.23.93 | 18)12.21.93 | | | | |
| Hp Hr/Lb | 0.125 | 0.125 | 0.125 | | | | |
| Passes | 4 | 8 | 12 | | | | |
| Speed | 154 | 308 | 488 | | | | |
| Baffle | T | T | T | | | | |
| Weight (gsy) | 165.74 | 167.33 | 166.94 | | | | |
| Weight (osy) | 5.85 | 5.90 | 5.89 | | | | |
| Thickness (mils) | 30.8 | 30.7 | 29.9 | | | | |
| Air Perm (cfm/sq.ft.) | 86 | 84 | 79 | | | | |
| Air perm grams | 14254 | 14056 | 13188 | | | | |
| WARP Shrinkage due to enhancement | 1.53% | 1.97% | 1.75% | | | | |
| WEFT Shrinkage | 5.03% | 6.56% | 6.13% | | | | |

NOTE: "T" IN THE BAFFLE ROW REFERS TO "TURBULENT FLOW".

TABLE 3

ENERGY AUDIT REGULAR FLOW

| | Control 12.16.93 | 1)12.16.93 | 2)12.16.93 | 3)12.16.93 | 4)12.16.93 | 5)12.16.93 | 6)12.16.93 | 7)12.16.93 |
|---|---|---|---|---|---|---|---|---|
| Hp Hr/Lb | 0 | 0.1 | 0.2 | 0.3 | 0.4 | 0.5 | 1 | 2 |
| Passes | 0 | 1 | 2 | 3 | 4 | 5 | 10 | 20 |
| Speed | 0 | 49 | 49 | 49 | 49 | 49 | 49 | 49 |
| Baffle | 0 | R | R | R | R | R | R | R |
| Weight (gsy) | 157.59 | 168.33 | 171.47 | 173.45 | 174.41 | 175.25 | 174.77 | 171.57 |
| Thickness (mils) | 28.3 | 31.4 | 32.5 | 32.7 | 32.2 | 32.2 | 32.6 | 31.9 |
| Air Perm (cfm/sq.ft.) | 245 | 138.00 | 97.40 | 79.80 | 67.60 | 66.96 | 54.58 | 50.43 |
| WARP Shrinkage due to enhancement | | 2.19% | 2.84% | 3.50% | 3.72% | 3.94% | 5.03% | 5.47% |
| WEFT Shrinkage | | 4.60% | 6.56% | 7.22% | 8.53% | 8.96% | 7.66% | 5.91% |

ENERGY AUDIT TURBULENT FLOW

| | Control 12.21.93 | 1)12.21.93 | 2)12.21.93 | 3)12.21.93 | 4)12.21.93 | 5)12.16.93 | 6)12.21.93 | 7)12.21.93 |
|---|---|---|---|---|---|---|---|---|
| Hp Hr/Lb | 0 | 0.1 | 0.2 | 0.3 | 0.4 | 0.5 | 1 | 2 |
| Passes | 0 | 1 | 2 | 3 | 4 | 5 | 10 | 20 |
| Speed | 0 | 49 | 49 | 49 | 49 | 49 | 49 | 49 |
| Baffle | 0 | T | T | T | T | T | T | T |
| Weight (gsy) | 156.33 | 162.76 | 164.48 | 165.65 | 166.19 | 164.58 | 162.57 | 159.43 |
| Thickness (mils) | 28.4 | 29.8 | 31.9 | 32.1 | 32.4 | 32.1 | 32.3 | 32.3 |
| Air Perm (cfm/sq.ft.) | 258 | 107.00 | 80.40 | 69.40 | 64.50 | 64.41 | 55.66 | 58.21 |
| Air perm grams | 244 | 106 | 80 | 70 | 65 | 64 | 55 | 56 |
| WARP Shrinkage due to enhancement | 0.44% | 1.53% | 1.53% | 1.53% | 1.53% | 1.75% | 1.31% | 0.88% |
| WEFT Shrinkage | 1.53% | 3.28% | 4.60% | 5.25% | 5.47% | 5.69% | 4.38% | 3.50% |

I claim:

1. An improved method of hydroenhancing fabric comprising: inducing turbulence in a fluid flow in proximity to a row of jet orifices in a manifold for hydroenhancing fabric so that a turbulent fluid flow impinges on the jet orifices and resulting jet streams issuing at an output end of the manifold are formed with a constant state of fluctuation in their cross-sectional shape, direction and structure, resulting in their delivered energy being distributed over constantly changing impact areas on the fabric, whereby more of the delivered energy is converted into enhancement energy for hydroenhancing the fabric.

2. An improved fabric hydroenhancing method according to claim 1, wherein the jet streams are formed as randomly spiralling ribbons or oscillating shape-changing streams.

3. An improved fabric hydroenhancing method according to claim 1, wherein inducing turbulence in the fluid flow is carried out by providing a baffle below a fluid-receiving plenum and distribution element in the manifold with a lower portion of the baffle in close proximity to the jet strip at an output end of the manifold and impinging the turbulent fluid flow onto the row of jet orifices.

4. An improved fabric hydroenhancing method according to claim 3, wherein the baffle is provided as a flat, rectangular plate having a plurality of small distribution holes along its centerline.

5. An improved fabric hydroenhancing method according to claim 3, wherein the baffle is provided as two rails aligned in parallel to form a slot along its centerline that can be adjusted in width for optimal tuning of turbulence induced in the manifold.

6. An improved fabric hydroenhancing method according to claim 3, wherein the baffle is provided with a solid center portion and fluid flow paths around its sides in order to redirect the fluid flow around the sides and apply the turbulent fluid flow uniformly across the row of jet orifices.

7. An improved fabric hydroenhancing method according to claim 1, wherein woven fabric is enhanced by said turbulence hydroenhancing method so as to have a reduced fabric shrinkage as compared to fabric enhanced with a regular fluid flow in the manifold.

8. An improved fabric hydroenhancing method according to claim 1, wherein woven fabric having warp yarns is enhanced by said turbulence hydroenhancing method so as to have substantially no interference patterns generated in the fabric due to interference between jet orifice and warp yarn spacings.

9. An improved fabric hydroenhancing method according to claim 1, wherein fabric is enhanced by said turbulence hydroenhancing method so as to achieve lower air permeability as compared to fabric enhanced with a regular fluid flow in the manifold.

10. An improved fabric hydroenhancing method according to claim 1, wherein fabric is enhanced by said hydroenhancing method at a total energy level of from 0.1 to 1.0 hp-hr/lb in a number of 6 or less passes.

11. An improved manifold for hydroenhancing fabric comprising:

a manifold body having upper walls defining a fluid-receiving plenum and a distribution element communicating with said plenum, and lower walls defining an output end mounting a jet strip with a row of jet orifices formed therein for issuing jet streams therefrom for hydroenhancing fabric; and a baffle positioned below the distribution element in the manifold with a lower portion of the baffle in close proximity to the jet strip at the output end of the manifold, said baffle having a structure for inducing turbulence in the fluid flow from the distribution element and impinging the turbulent fluid flow onto the row of jet orifices.

12. An improved manifold for hydroenhancing fabric according to claim 11, wherein said baffle structure is configured to cause jet streams to issue from the jet orifices formed with a constant state of fluctuation in their cross-sectional shape, direction, and structure, resulting in their delivered energy being distributed over constantly changing impact areas on the fabric.

13. An improved manifold for hydroenhancing fabric according to claim 12, wherein said baffle structure is configured to cause the jet streams to randomly spiral or oscillate constantly.

14. An improved manifold for hydroenhancing fabric according to claim 11, wherein said baffle is a flat, rectangular plate having a plurality of small holes along its centerline.

15. An improved manifold for hydroenhancing fabric according to claim 11, wherein said baffle has two rails aligned in parallel to form a slot along its centerline, and slot width adjustment means provided with said rails for adjusting the width of the slot for optimal tuning of turbulence induced in the manifold.

16. An improved manifold for hydroenhancing fabric according to claim 11, wherein said baffle has a solid center portion and fluid flow paths around its sides to redirect the fluid flow around the sides and apply the turbulent fluid flow uniformly across the row of jet orifices.

17. An improved manifold for hydroenhancing fabric according to claim 11, wherein the lower portion of said baffle is spaced between about 0.25 and 0.10 inch above the row of jet orifices.

18. An improved manifold for hydroenhancing fabric according to claim 11, wherein said manifold has jet orifices spaced with a density less than 60 jets/inch and with a orifice diameter greater than 0.005 inch.

19. An improved manifold for hydroenhancing fabric according to claim 11, wherein said baffle has a hollow, elongated channel shape formed by an upper wall having openings formed along its two lengthwise sides, vertical side walls, and a lower wall having a central slot formed lengthwise therein positioned directly above the row of orifices in the jet strip.

20. An improved manifold for hydroenhancing fabric according to claim 19, wherein opposing lateral sides of the lower wall of said baffle are inclined downwardly toward the central slot by about a 100° angle from the vertical, the central slot has a width of about 0.25 inch, and the central slot is spaced about 0.10 inch above the row of jet orifices.

* * * * *